US006582869B2

(12) United States Patent
Daimon et al.

(10) Patent No.: US 6,582,869 B2
(45) **Date of Patent: *Jun. 24, 2003**

(54) ELECTROPHOTOGRAPHIC TONER, METHOD OF MANUFACTURING THE SAME, ELECTROPHOTOGRAPHIC DEVELOPER, AND IMAGE FORMING METHOD

(75) Inventors: Katsumi Daimon, Odawara (JP); Norihito Fukushima, Hadano (JP); Takashi Imai, Odawara (JP); Manabu Serizawa, Odawara (JP); Hirokazu Hamano, Ashigarakami-gun (JP); Masanori Ichimura, Hadano (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/818,864

(22) Filed: Mar. 28, 2001

(65) Prior Publication Data

US 2002/0018952 A1 Feb. 14, 2002

(30) Foreign Application Priority Data

Jun. 28, 2000 (JP) ..... 2000-193806
Nov. 24, 2000 (JP) ..... 2000-357420

(51) Int. Cl.[7] ..... G03G 9/087

(52) U.S. Cl. ..... 430/109.4; 430/137.14; 430/111.4; 430/124

(58) Field of Search ..... 430/109.4, 111.4, 430/137.14, 124

(56) References Cited

U.S. PATENT DOCUMENTS

| | | | | |
|---|---|---|---|---|
| 3,853,778 A | | 12/1974 | Buckley et al. | |
| 4,931,375 A | * | 6/1990 | Akimoto et al. | 430/109.4 |
| 5,057,392 A | * | 10/1991 | McCabe et al. | 430/109.4 |

FOREIGN PATENT DOCUMENTS

| | | |
|---|---|---|
| JP | B 42-23910 | 11/1967 |
| JP | B2 56-13943 | 4/1981 |
| JP | B2 62-39428 | 8/1987 |
| JP | B2 63-25335 | 5/1988 |
| JP | A 4-120555 | 4/1992 |
| JP | B2 4-30014 | 5/1992 |
| JP | A 4-239021 | 8/1992 |
| JP | A 5-165252 | 7/1993 |

OTHER PUBLICATIONS

Diamond, Arthur S. (editor) Handbook of Imaging Materials. New York: Marcel–Dekker, Inc. pp. 162–163. (1991).*

* cited by examiner

*Primary Examiner*—Christopher Rodee
(74) *Attorney, Agent, or Firm*—Oliff & Berridge, PLC

(57) ABSTRACT

An electrophotographic toner contains a colorant and a binder resin which includes and a crystalline polyester resin as a main component. An ester density M of the crystalline polyester resin, as defined in the following Formula 1, is from 0.01 to 0.12:

$$M=K/A \qquad \text{Formula 1}$$

wherein M denotes an ester density, K denotes a number of ester groups, and A denotes a number of atoms which constitute the high molecular chain of a polymer.

14 Claims, 1 Drawing Sheet

ELECTROPHOTOGRAPHIC TONER, METHOD OF MANUFACTURING THE SAME, ELECTROPHOTOGRAPHIC DEVELOPER, AND IMAGE FORMING METHOD

BACKGROUND OF THE INVENTION

1. Field of the Invention

The present invention relates to an electrophotographic toner which is used in electrophotographic apparatuses that utilize an electrophotographic process, such as copying machines, printers, facsimiles, and the like, a method of manufacturing the same, an electrophotographic developer, and an image-forming method.

2. Description of the Related Art

As described in Japanese Patent Application Publication (JP-B) No. 42-23910 and the like, a number of methods are known as electrophotographic methods. In general, a latent image is formed electrically by one of various means on the surface of a photorecepter (latent image holding material) which utilizes a photoconductive substance. The formed latent image is developed using a toner, and thus a toner image is formed. Thereafter, the toner image on the surface of the photorecepter is transferred onto the surface of a transfer material such as paper or the like via or not via an intermediate transfer material. The transferred image is subjected to a plurality of fixing processes such as heating, pressurizing, heat-pressurizing, solvent vapor, and the like, such that a fixed image is formed. Toner which remains on the surface of the photorecepter is cleaned by various methods as necessary and is subjected to the above-described plurality of processes again.

As a fixing technique for fixing a transferred image which has been transferred onto the surface of a transfer material, a heat roll fixing method is generally known. In this method, a transfer material, onto which a toner image has been transferred, is inserted and fixed between a pair of rolls which is formed by a heat roll and a pressure roll. Further, as the same type of technique, a technique of replacing one or both of the rolls with a belt (belts) is also known. In these techniques, compared to other fixing methods, a fast fixed image is obtained quickly, energy efficiency is high, and harm to the environment due to volatilization of a solvent or the like is small.

On the other hand, in order to reduce the amount of energy used by a copying machine or printer, a technique for fixing a toner with less energy is desired. Accordingly, demand for an electrophotographic toner which can be fixed at a lower temperature is strong.

As a means of lowering the fixing temperature of a toner, a technique of lowering the glass transition temperature of a toner resin (binder resin) is generally effected.

However, if the glass transition temperature is too low, flocculation ("blocking") of fine particles easily occurs and storability of toner as the fixed image is lost. As a result, the minimum glass transition temperature is 60° C. in practice. The glass transition temperature is a design point of many toner resins which are available at present. There is a problem in that a toner which can be fixed at an even lower temperature cannot be obtained by simply using methods of lowering glass transition temperature. Moreover, the fixing temperature can also be lowered using a plasticizer. However, there is a drawback in that blocking occurs during storage of a toner or in the developing machine.

As a means of preventing blocking, having image storability up to 60° C., and having low temperature fixability, a technique of using a crystalline resin as a binder resin for forming a toner has been considered and has been known (JP-B-56-13943 and the like). Further, a technique of using a crystalline resin for the purpose of preventing offset (JP-B-62-39428), of pressure fixing (JP-B-63-25335), and the like has been known.

The above disclosed techniques have problems. For example, in the technique disclosed in JP-B-56-13943, a polymer which has an alkyl group side chain having 14 or more carbon atoms is used in a toner. The melting point of the polymer is as low as 62 to 66° C. Because of the excessively low temperature, there is a problem of reliability of fine particles and images. Moreover, in crystalline resins described in JP-B-62-39428 and JP-B-63-25335, there is a problem in that fixing performances thereof with paper are not sufficient.

A crystalline resin, with which an improvement of fixability with a paper is sought, includes a polyester resin. A technique of using crystalline polyester resin for a toner is described in JP-B-62-39428. In this technique, an amorphous polyester resin having a glass transition temperature of 40° C. or more and a crystalline polyester resin having a melting point of from 130 to 200° C. are mixed and used.

This technique provides excellent pulverizing ability and blocking resistance. However, since the melting point of the crystalline polyester resin is high, there is a drawback in that fixability at lower temperatures cannot be achieved.

In order to solve the above-described drawback, a technique of using a toner in which a crystalline resin having a melting point of 110° C. or less is mixed with an amorphous resin (JP-B-4-30014) is proposed.

However, if the amorphous resin is mixed with the crystalline resin, there are practical problems such as lowering of the melting point of the toner, occurrence of toner blocking, deterioration of the storability of an image, and the like. Further, if an amount of amorphous resin component is large, characteristics of the amorphous resin component are greatly reflected. Accordingly, it is difficult to lower the fixing temperature of the toner more than tat of the conventional toner. As a result, the crystalline resin is used alone as a toner resin or, if the amorphous resin is mixed in, the amount of the amorphous resin has to be very small or there will be a practical problems.

As described above, it is desirable that a crystalline polyester resin is used for heat roll fixing as alone as possible. A technique of using crystalline polyester resin is described in Japanese Patent Application Laid-Open (JP-A) Nos. 4-120555, 4-239021, 5-165252, and the like. However, in these techniques, the crystalline polyester resin is a resin using alkylene glycol or alicyclic alcohol, which has few carbon atoms compared to the carboxylic acid component of terephthalic acid.

These polyester resins are described above as crystalline polyester resins. However, actually, these are partial crystalline polyester resins. As a result, a viscosity change of the toner (resin) with temperature is not sharp. Although there is no problem with blocking resistance and storability of an image, low temperature fixing cannot be achieved in heat roll fixing.

On the other hand, the present inventors have disclosed in the specification of JP-A-11-300158 that a toner which includes a crystalline polyester resin having a crosslinking structure as a main component has excellent blocking resistance, excellent storability of an image, and can realize low temperature fixing. However, in this toner as well, improvement of chargeability is further desired, especially in two-component charging with a carrier.

SUMMARY OF THE INVENTION

A subject of the present invention is to solve the above-described conventional problems and to achieve the following object. Namely, the object of the present invention is to provide an electrophotographic toner which has excellent blocking resistance, excellent storability of an image, excellent fixability at a low temperature and, further, excellent chargeability; a method of manufacturing the same; an electrophotographic developer; and an image-forming method.

The above-described first object is achieved in accordance with the following present invention. Namely, a first aspect of the present invention is an electrophotographic toner which comprises a binder resin and a colorant. The binder resin comprises a crystalline polyester resin as a main component, and an ester density M of the crystalline polyester resin, which is defined in Formula 1 as follows, is from 0.01 to 0.12:

$$M=K/A \qquad \text{Formula 1}$$

wherein M denotes the ester density, K denotes a number of ester groups in a polymer, and A denotes a number of atoms constituting a high molecular chain of the polymer.

The second object is achieved in accordance with a following method for manufacturing an electrophotographic toner. The method comprises the steps of:

emulsifying a crystalline polyester resin; and aggregating and coalescing the emulsified crystalline polyester resin, adjusting the crystalline polyester resin to toner size, and preparing an electrophotographic toner comprising a colorant and a binder resin, the binder resin including the crystalline polyester resin as a main component, and an ester density M of the crystalline polyester resin, which is defined in Formula 1 as follows, being from 0.01 to 0.12:

$$M=K/A \qquad \text{Formula 1}$$

wherein M denotes the ester density, K denotes a number of ester groups in a polymer, and A denotes a number of atoms constituting a high molecular chain of the polymer.

Further, preferably, the crystalline polyester resin contains, as a copolycondensation component, a bivalent or more carboxylic acid having a sulfonic acid group.

The third object is achieved in accordance with a following method. The image forming method comprises the steps of:

forming an electrostatic latent image on a surface of a latent image holding material;

providing a developer comprising an electrophotographic toner including a colorant and a binder resin, and the binder resin comprising a crystalline polyester resin as a main component, and an ester density M of the crystalline polyester resin, which is defined in Formula 1 as follows, is from 0.01 to 0.12:

$$M=K/A \qquad \text{Formula 1}$$

wherein M denotes the ester density, K denotes a number of ester groups in a polymer, and A denotes a number of atoms constituting a high molecular chain of the polymer;

forming a toner image from the electrostatic latent image formed on the surface of the latent image holding material by using the developer held on a developer holding member;

transferring the toner image formed on the surface of the latent image holding material onto a surface of a transfer material; and heat-fixing the toner image transferred on the surface of the transfer material.

It is desirable that the above crystalline polyester resin is a straight chain aliphatic polyester resin. Further, it is desirable that a crystalline polyester-constituting component contains a dicarboxylic acid having at least one sulfonic acid group and/or a diol having at least one sulfonic acid group.

DESCRIPTION OF THE PREFERRED EMBODIMENTS

Figure 1:
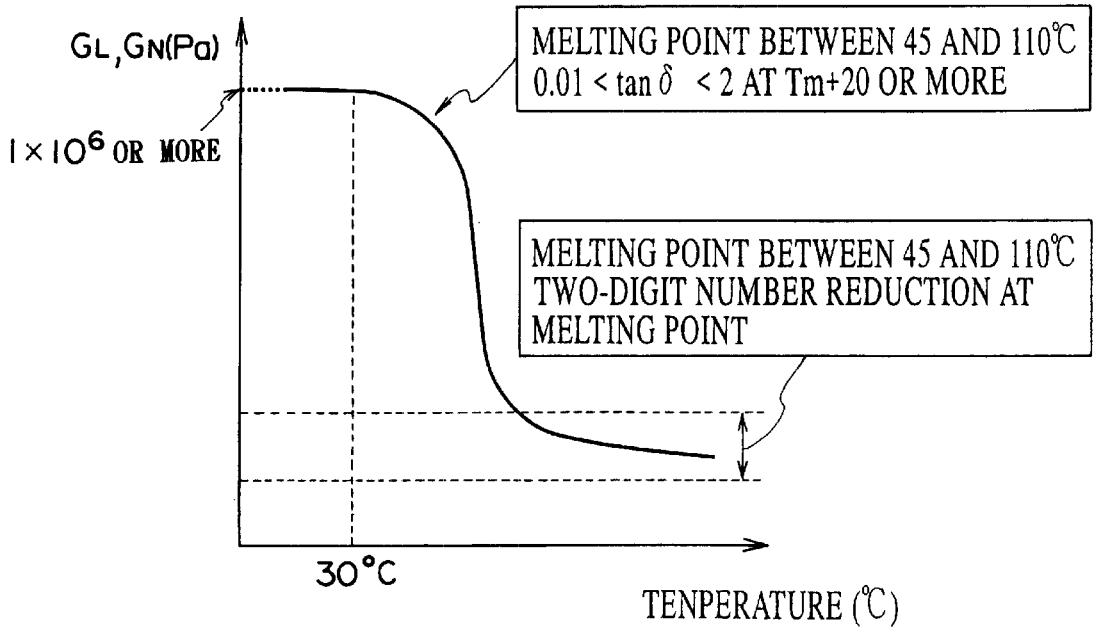
FIG. 1 is a graph showing preferable characteristics of an electrophotographic toner of the present invention. A common logarithm of storage modulus, log $G_L$, or common logarithm of loss modulus, log $G_N$, is shown by the vertical axis and temperature is shown by the horizontal axis.

Hereinafter, the present invention will be described in detail.

[Electrophotographic Toner]

An electrophotographic toner (hereinafter, the electrophotographic toner may be referred to simply as "toner") of the present invention includes a binder resin and a colorant and contains other components as necessary. First, respective components of the electrophotographic toner of the present invention will be described in detail.

<Binder Resin>

A binder resin in the toner of the present invention includes, as a main component, a crystalline polyester resin having an ester density M, which is defined as follows (Formula 1), of 0.01 or more and 0.12 or less.

$$M=K/A \qquad \text{Formula 1}$$

(Wherein M denotes an ester density, K denotes a number of ester groups in the polymer, and A denotes the number of atoms which constitute a high molecular chain of a polymer.)

"Ester Density M", which is a characteristic of the present invention, is an index which shows a rate at which ester groups are contained in the polymer of the crystalline polyester resin.

"Number of Ester Groups in Polymer", which is expressed as K in the above formula, denotes, in other words, the number of ester linkages which are included in the entire polymer of the crystalline polyester resin.

"Number of Atoms which Constitute the High Molecular Chain of the Polymer", which is expressed as A in the above formula, is the total number of atoms which constitute the high molecular chain of the polymer of the crystalline polyester resin. Further, the number of atoms includes all atoms which relate to ester linkage, but does not include the atoms of branched portions in other constitutive regions. Namely, a carbon atom and an oxygen atom (the number of oxygen atoms in one ester linkage is two) which relate to the ester linkage and are derived from a carboxyl group or an alcohol group, and a carbon and the like which constitutes the high molecular chain, e.g., six carbons in an aromatic ring, are included in the above calculation of number of atoms. However, a hydrogen atom which constitutes the high molecular chain, e.g., a hydrogen atom in an aromatic ring or an alkyl group, and an atom or atomic group of a substituent thereof are not included in the above calculation of number of atoms.

Explanation is given using concrete examples. Among a total of ten atoms, in an arylene group which constitutes a high molecular chain, that is six carbon atoms and four hydrogen atoms, only the six carbon atoms are included in the above "Number A of Atoms which Constitute the High Molecular Chain of the Polymer". The hydrogen is not included. Moreover, if the above hydrogen atom is substituted with any substituent, the atoms which constitute the substituent are not included in the above "Number A of Atoms which Constitute the High Molecular Chain of the Polymer".

When the crystalline polyester resin is a single polymer which is formed by only one repeated unit, the ester density M can be obtained as follows. (For example, if a macromolecule is expressed as $H—[OCOR^1COOR^2O—]_n—H$, the one repeated unit is expressed inside the [ ].) In the one repeated unit, there are, for example, two ester linkages. Namely, the number K' which is a number of ester groups in the one repeated unit is two. Accordingly, the ester density M could be obtained in the following formula (1-1).

$$M=2/A' \quad \text{(Formula 1-1)}$$

(Wherein M denotes ester density, and A' denotes the number of atoms which constitute the high molecular chain in the one repeated unit.)

Further, when the crystalline polyester resin is a copolymer which is formed by a plurality of copolymerization units, the ester density M can be obtained as follows. First, in each of copolymerization units, the number of ester groups $K^x$ and the number of atoms which constitute the high molecular chain $A^x$ are obtained. These numbers are multiplied by the rate of copolymerization and are respectively summed. By substituting the summed numbers in the above Formula 1, the ester density M can be obtained. For example, the ester density M of a compound $[(Xa)_a(Xb)_b(Xc)_c]$ in which the copolymerization units are Xa, Xb, and Xc and the copolymerization rates thereof are a:b:c(a+b+c=1) can be obtained in accordance with the following formula (1-2).

$$M=\{K^{Xa}\times a+K^{Xb}\times b+K^{Xc}\times c\}/\{A^{Xa}\times a+A^{Xb}\times b+A^{Xc}\times c\} \quad \text{(Formula 1-2)}$$

(Wherein M denotes ester density; $K^{Xa}$ denotes the number of ester groups in the copolymerization unit Xa, $K^{Xb}$ denotes the number of ester groups in the copolymerization unit Xb, and $K^{Xc}$ denotes the number of ester groups in the copolymerization unit Xc; and $A^{Xa}$ denotes the number of atoms which constitute the high molecular chain in the copolymerization unit Xa, $A^{Xb}$ denotes the number of atoms which constitute the high molecular chain in the copolymerization unit Xb, and $A^{Xc}$ denotes the number of atoms which constitute the high molecular chain in the copolymerization unit Xc.)

When the crystalline polyester resin is used as the binder resin, it has been clarified by the studies of the present inventors that an amount of ester groups existing in the polymer affects chargeability of the toner particularly greatly. Accordingly, a key to improving the chargeability is to reduce the amount of ester groups in the polymer, within a range in which the low temperature fixability is not deteriorated. In the present invention, the ester density M, which is defined in the above Formula 1, of the crystalline polyester resin which is used as the binder resin of the toner is reduced to from 0.01 or more to 0.12 or less. Thus, it is possible to obtain a toner having excellent toner blocking resistance, excellent storability of an image, excellent fixability at a low temperature, and excellent chargeability.

If the ester density M is less than 0.01, the chargeability is good. However, since the melting point of the resin is too high, the low temperature fixability is reduced. The lower limit of the ester density M is preferably 0.02 and is more preferably 0.04.

On the other hand, if the ester density M exceeds 0.12, the chargeability lowers, and the melting point of the resin is too low. Therefore, stability of a fixed image and fine particle blocking ability are deteriorated. The upper limit of the ester density M is preferably 0.11 and is more preferably 0.10.

As mentioned above, the binder resin in the toner of the present invention includes, as the main component, the crystalline polyester resin having an ester density M as defined in Formula 1 of from 0.01 or more to 0.12 or less (hereinafter, the crystalline polyester resin may be referred to simply as "specific polyester resin"). The "main component" herein denotes a main component among components which constitute the above binder resin. More specifically, the main component denotes a component which constitutes 50% or more of the above binder resin. In the present invention, the specific polyester resin is preferably 70% or more of the above binder resin, is more preferably 90% or more thereof, and is particularly preferably 100% thereof.

All polyester resins including the specific polyester resin are synthesized by an acid (dicarboxylic acid) component and an alcohol (diol) component. In the description hereinafter, in the polyester resin, a constitutive region which was the acid component before synthesis of the polyester resin is denoted "acid-derived constitutive component" and a constitutive region which was the alcohol component before the synthesis of the polyester resin is denoted "alcohol-derived constitutive component".

It is necessary that the main component of the binder resin of the toner in the present application is a crystalline polyester resin. If the specific polyester resin is not crystalline, i.e., is amorphous, it is impossible to maintain the toner blocking resistance and the image storability while maintaining the good low temperature fixability.

In the present invention, "crystallinity" of the "crystalline polyester resin" denotes that the resin has a clear endothermic peak and does not have a step-formed endothermic amount change in a differential scanning calorimetry (DSC). Further, when the resin serves as a toner, the endothermic peak may show a peak having a width of 40 to 50° C. In the case of a polymer in which another component is copolymerized with the above-described crystalline polyester main chain, as long as the other component is 50% by weight or less, the copolymer is still referred to as crystalline polyester.

Acid Derived Constitutive Component

Acid which is to be the above acid-derived constitutive component includes various dicarboxylic acids. The acid-derived constitutive component of the specific polyester resin is preferably an aromatic dicarboxylic acid or an aliphatic dicarboxylic acid. Among these, the aliphatic dicarboxylic acid is desirable and, in particular, a straight chain-type carboxylic acid is desirable.

Examples of the aliphatic dicarboxylic acid includes oxalic acid, malonic acid, succinic acid, glutaric acid, adipic acid, pimelic acid, suberic acid, azelaic acid, sebacic acid, 1,9-nonanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and the like, and lower alkyl esters and acid anhydrides thereof. However, the aliphatic dicarboxylic acid is not limited to these. Of these, if availability is taken into account, sebacic acid and 1,10-decanedicarboxylic acid are preferable.

Examples of the aromatic dicarboxylic acid includes terephthalic acid, isophthalic acid, 2,6-naphthalenedicarboxylic acid, 4,4'-biphenyldicarboxylic acid, and the like. Of these, terephthalic acid is preferable from the point of availability, the point of it being is easy to form a low melting point polymer, and the like.

As the above acid-derived constitutive component, in addition to the aforementioned aliphatic dicarboxylic acid-derived constitutive component or aromatic dicarboxylic acid-derived constitutive component, it is also preferable that the resin includes a constitutive component such as a dicarboxylic acid-derived constitutive component having a double bond, a dicarboxylic acid-derived constitutive component having a sulfonic acid group, or the like.

It should be noted that, in addition to the constitutive component which is derived from the dicarboxylic acid having a double bond, the above dicarboxylic acid-derived constitutive component having a double bond includes a constitutive component derived from a lower alkyl ester, acid anhydride or the like of a dicarboxylic acid having a double bond. Moreover, in addition to the constitutive component which is derived from a dicarboxylic acid having a sulfonic acid group, the above dicarboxylic acid-derived constitutive component having a sulfonic acid group includes a constitutive component derived from a lower alkyl ester, acid anhydride or the like of a dicarboxylic acid having a sulfonic acid group.

Because the entire resin can be crosslinked using the double bond, the above dicarboxylic acid having a double bond can be used preferably in order to prevent hot offset at a time of fixing. Examples of the dicarboxylic acid includes fumaric acid, maleic acid, 3-hexenedioic acid, 3-octenedioic acid, and the like. However, the dicarboxylic acid is not limited to these. Further, lower alkyl esters, acid anhydrides, and the like thereof are also included. Of these, fumaric acid, maleic acid, and the like are preferable from the point of cost.

The above dicarboxylic acid having a sulfonic acid group is effective from the point that a coloring material such as a pigment or the like can be well dispersed. Further, when the entire resin is emulsified or suspended in water and a particulates is thereby prepared, if there is a sulfonic acid group, emulsification or suspension can be carried out without using a surfactant. Examples of the dicarboxylic acid having a sulfonic acid group includes 2-sulfoterephthalic acid sodium salt, 5-sulfoisophthalic acid sodium salt, sulfosuccinic acid sodium salt, and the like. However, the dicarboxylic acid having a sulfonic acid group is not limited to these. Moreover, the lower alkyl esters, acid anhydrides, and the like thereof are also included. Of these, 5-sulfoisophthalic acid sodium salt is preferable from the point of cost.

The amount of content of among all acid-derived constitutive components of acid-derived constitutive components other than the aliphatic dicarboxylic acid-derived constitutive component and the aromatic dicarboxylic acid-derived constitutive component (i.e., the dicarboxylic acid-derived constitutive component having a double bond and/or the dicarboxylic acid-derived constitutive component having a sulfonic acid group) is preferably from 1 to 20 mole % by constitution and is more preferably from 2 to 10 mole % by constitution.

If the above amount of content is less than 1 mole % by constitution, pigment dispersion is not good or emulsified particle size is large. Consequently, it may be difficult to adjust toner size due to flocculation. On the other hand, if the amount of content exceeds 20 mole % by constitution, the crystallinity of the polyester resin is reduced and the melting point drops, such that the storability of an image may be deteriorated. Alternatively, the emulsified particle size is too small and the particles are dissolved into water, such that a latex may not be generated.

In the present specification, "mole % by constitution" indicates a percentage when the respective constitutive components (acid-derived constitutive component or alcohol-derived constitutive component) in the polyester resin make up one unit (mole).

<Alcohol-Derived Constitutive Component>

The alcohol which is to become an alcohol-derived constitutive component is preferably an aliphatic diol and is more preferably a straight chain-type aliphatic diol having 7 to 20 chain carbon atoms. If the above aliphatic diol is a branched type, the crystallinity of the polyester resin lowers and the melting point drops. Accordingly, the toner blocking resistance, the image storability, and the low temperature fixability may be deteriorated. Further, if the number of the chain carbon atoms is less than 7, when the aliphatic diol is subjected to condensation polymerization with an aromatic dicarboxylic acid, the melting point becomes high and low temperature fixing may be difficult. On the other hand, if the number of the chain carbon atoms exceeds 20, it tends to be difficult to obtain practical materials. The number of chain carbon atoms is more preferably 14 or less.

Further, when the aliphatic diol is subjected to condensation polymerization with an aromatic dicarboxylic acid and thereby polyester is obtained, the above number of chain carbon atoms is preferably an odd number. In the case in which the above number of chain carbon atoms is an odd number, the melting point of the polyester resin is lower as compared to a case in which the number of chain carbon atoms is an even number. Consequently, it is easier to have the melting point be a value which falls within a preferable range of numerical values, which will be described later.

More specifically, examples of the aliphatic diol includes ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. However, the aliphatic diol is not limited to these. Of these, when availability is taken into consideration, 1,8-octanediol, 1,9-nonanediol, 1,10-decanediol are preferable. Moreover, 1,9-nonanediaol is preferable from the point of low melting point.

In the above alcohol-derived constitutive component, the amount of content of the aliphatic diol-derived constitutive component is 80 mole % by constitution or more. The alcohol-derived constitutive component includes other components as necessary. In the above alcohol-derived constitutive component, the amount of content of the above aliphatic diol-derived constitutive component is preferably 90 mole % by constitution or more.

If the amount of content of the above aliphatic diol-derived constitutive component is less than 80 mole % by constitution, the crystallinity of the polyester resin lowers, and thus the melting point drops. As a result, the toner blocking resistance, the image storability, and the low temperature fixability may be deteriorated.

The other components which are included as necessary are constitutive components such as a diol-derived constitutive component having a double bond(s), a diol-derived constitutive component having a sulfonic acid group(s), and the like.

Examples of the above diol-derived constitutive component having a double bond includes 2-butene-1,4-diol, 3-butene-1,6-diol, 4-butene-1,8-diol, and the like.

Examples of the above diol having a sulfonic acid group include 1,4-dihydroxy-2-sulfonic acid benzene sodium salt, 1,3-dihydroxymethyl-5-sulfonic acid benzene sodium salt, 2-sulfo-1,4-butanediol sodium salt, and the like.

If alcohol-derived constitutive components (i.e., the diol-derived constitutive component having a double bond and/or the diol-derived constitutive component having a sulfonic acid group) other than the aliphatic diol-derived constitutive component are added, the amount of content of the other alcohol-derived constitutive components is preferably from 1 to 20 mole % by constitution and is more preferably from 2 to 10 mole % by constitution.

If the amount of content of the alcohol-derived constitutive components other than the above aliphatic diol-derived constitutive component is less than 1 mole % by constitution, the pigment dispersion is not good or the emulsified particle size is large. Thus, it may be difficult to adjust the toner size by flocculation. On the other hand, if the amount of content exceeds 20 mole % by constitution, the crystallinity of the polyester resin lowers or the melting point drops, such that the storability of an image may be deteriorated. Alternatively, the emulsified particle size is too small and the particles are dissolved into water, such that a latex may not be generated.

The melting point of the above crystalline polyester resin is preferably from 60 to 120° C., is more preferably from 65 to 110° C., and is furthermore preferably from 70 to 100° C.

If the above melting point is less than 60° C., the flocculation of fine particles may easily occur or the storability of a fixed image may be deteriorated. On the other hand, if the melting point exceeds 120° C., the low temperature fixing cannot be carried out.

In the present invention, differential scanning calorimetry (DSC) was used to measure the melting points of the above polyester resin. The top value of an endothermic peak was used and measurement was carried out from the room temperature to 150° C. at the programming rate of 10° C. per minute.

A method of manufacturing the above crystalline polyester resin is not limited in particular. The crystalline polyester resin can be manufactured in accordance with a general polyester polymerization method which causes an acid component and an alcohol component to react. For example, the crystalline polyester resin is manufactured using direct polycondensation, a transesterification method, or the like in accordance with the type of a monomer. When the above acid component and the above alcohol component are caused to react, since a mole ratio (acid component/alcohol component) varies due to reaction conditions or the like, the mole ratio cannot be generalized. Usually, the mole ratio is approximately 1/1.

The above polyester resin can be manufactured at a polymerization temperature of between 180 and 230° C. Pressure within a reaction system is reduced as necessary, and the reaction is carried out while removing water or alcohol which is generated at the time of condensation.

If the monomer does not dissolve or is not compatible at the reaction temperature, a high boiling point solvent is added thereto as a solubilizing agent and thus the monomer is dissolved. The polycondensation reaction is effected while removing the solubilizing agent by distillation. If there is a poorly compatible monomer in the copolymerization reaction, the poorly compatible monomer is subjected to condensation beforehand with the acid or alcohol which is scheduled for polycondensation, and then the condensed product is subjected to polycondensation with the main component.

Examples of a catalyst which can be used when the above polyester resin is manufactured include: compounds of alkaline metals such as sodium, lithium, and the like; compounds of alkaline earth metals such as magnesium, calcium, or the like; a metal compound such as zinc, manganese, antimony, titanium, tin, zirconium, germanium, and the like; a phosphorous acid compounds; phosphoric acid compounds; amine compounds; and the like. More specifically, the following compounds are included.

For example, there are compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltindichloride, dibutyltinoxide, diphenyltinoxide, zirconium tetrabutoxide, zirconium naphthenate, zirconyl carbonate, zirconyl acetate, zirconyl stearate, zirconyl octylate, germanium oxide, triphenylphosphite, tris(2,4-di-t-butylphenyl) phosphite, ethyltriphenylphosphoniumbromide, triethylamine, triphenylamine, and the like.

<Colorant>

The colorant in the toner of the present invention is not limited in particular. Known colorants can be applied and selected appropriately in response to purpose. A pigment may be used alone or two or more of a similar type of pigments may be mixed and used. Further, two or more different types of pigments may be mixed and used. More specifically, examples of the above-described colorant includes carbon black (furnace black, channel black, acetylene black, thermal black, and the like), inorganic pigments such as red iron oxide, aniline black, iron blue, titanium oxide, magnetic powder, and the like; azo pigments such as Fast Yellow, Monoazo Yellow, Disazo Yellow, pyrazolone red, chelate red, Brilliant Carmine (3B, 6B, and the like), Para Brown, or the like; phthalocyanine pigments such as copper phthalocyanine, nonmetal phthalocyanine, and the like; condensation polycyclic pigments such as flavanthrone yellow, dibromoanthrone orange, perylene red, Quinacridone Red, Dioxazine Violet, and the like; and the like.

Further, examples of the colorant include various pigments such as chrome yellow, Hansa Yellow, benzidine yellow, thren yellow, quinoline yellow, Permanent orange GTR, pyrazolone orange, vulcanized orange, permanent red, Dupont oil red, lithol red, Rhodamine B Lake, Lake Red C, Rose bengal, aniline blue, ultramarine blue, Carcoyl blue, methylene blue chloride, Phthalocyanine blue, Phthalocyanine green, Marakite green oxalate, Para Brown, and the like; various dyes such as acridines, xanthenes, azos, benzoquinones, azines, anthraquinones, dioxazines, thiazines, azomethines, indigos, thioindigos, phthalocyanines, aniline blacks, polymethines, triphenylmethanes, diphenylmethanes, thiazoles, xanthenes, and the like; and the like. A black pigment such as carbon black or a dye may be mixed with these colorants to a degree such that transparency is not reduced. Moreover, disperse dyes, oil-soluble dyes, and the like are also included.

The amount of content of the above colorant in the electrophotographic toner of the present invention is preferably from 1 to 30 parts by weight based on 100 parts by weight of the above binder resin. It is preferable that the amount of content of the colorant is as great as possible within this range of numerical values but in a range in which smoothness of the image surface after the fixing is not damaged. When the amount of content of the colorant is increased, even if an image having the same density is obtained, the thickness of the image can be decreased. Thus, it is advantageous from the point of effectively preventing offset.

By selecting the type of the above colorant appropriately, respective color toners such as yellow toner, magenta toner, cyan toner, black toner, and the like can be obtained.

<Other Components>

The above-described other components which can be used for the toner of the present invention are not limited in particular and can be selected appropriately in response to purpose. For example, the other components include various known additives such as inorganic fine particles, organic fine particles, a charge controlling agent, a mold releasing agent, or the like.

The above inorganic fine particles are used in general for the purpose of improving fluidity of the toner. Examples of the above inorganic fine particles include fine particles of silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, silicon nitride, and the like. Among these, silica fine particles are preferable, and silica fine particles which have been hydrophobizated are particularly preferable.

The average primary particle size (number average particle size) of the above inorganic fine particles is preferably from 1 to 1000 nm, and the amount added (from outside) thereof is preferably from 0.01 to 20 parts by weight based on 100 parts by weight of the toner.

The above organic fine particles are used in general for the purpose of improving cleanability and transferability. Examples of the organic fine particles include fine particles of polystyrene, polymethyl methacrylate, polyvinylidene fluoride, and the like.

The above charge controlling agent is used in general for the purpose of improving chargeability. Examples of the above charge controlling agent includes metal salts of salicylic acid, metal-containing azo compounds, nigrosine, quaternary ammonium salts, and the like.

The above mold releasing agent is used in general for the purpose of enhancing a releasing property. Concrete examples of the mold releasing agent are low molecular weight polyolefins such as polyethylene, polypropylene, polybutene, or the like; silicones having a softening point upon heating; fatty acid amides such as amide oleate, erucic amide, amide ricinolate, amide stearate, or the like; vegetable waxes such as carnauba wax, rice wax, candelilla wax, haze wax, jojoba oil, or the like; animal waxes such as beeswax or the like; mineral/petroleum waxes such as montan wax, ozokerite, ceresin, paraffin wax, microcrystalline wax, Fischer-Tropsch wax, or the like; ester waxes such as fatty acid ester, montan acid ester, carboxylate, or the like; and the like. In the present invention, these mold releasing agents may be used alone or in a combination of two or more.

An amount added of these mold releasing agents is preferably from 0.5 to 50% by weight based on the entire amount of toner. The amount added is more preferably from 1 to 30% by weight and is further preferably from 5 to 15% by weight. If the amount added is less than 0.5% by weight, addition of the mold releasing agent is not effective. If the amount added is 50% by weight or more, chargeability is easily affected or the toner is easily destroyed within the developing machine. Thus, the mold releasing agent will become spent to a carrier and effects such as reduction in charging or the like will occur. In addition, for example, when a color toner is used, impregnation of the toner onto the image surface at the time of fixing will tend to be insufficient and the mold releasing agent will tend to remain in the image. Accordingly, transparency will deteriorate, which is not preferable.

<Other Structures>

The surface of the electrophotographic toner of the present invention may be covered with a surface layer. It is desirable that the surface layer does not greatly affect the mechanical characteristics and the melt viscoelastic characteristics of the entire toner. For example, if the toner is covered thickly with a non-melting surface layer or a high melting point surface layer, the low temperature fixability which is obtained by using the crystalline polyester resin cannot be demonstrated sufficiently.

Therefore, it is desirable that the membrane of the surface layer is thin. More specifically, the membrane thickness of the surface layer is preferably within the range of 0.001 to 0.5 $\mu$m.

In order to form the thin surface layer within the above-described range, a method of chemically processing the surface of particles which include the binder resin, the colorant, the inorganic fine particles which are added as necessary and the other materials is suitably used.

A component which forms the surface layer includes a silane coupling agent, isocyanates, vinyl monomer, and the like. Further, it is preferable that a polar group is introduced into the component. By bonding chemically due to the polar group, adhesive strength between the toner and a transfer material such as paper or the like increases.

The above-described polar group may be any group, provided that the polar group is a polarizable functional group. For example, the polar group includes a carboxyl group, a carbonyl group, an epoxy group, an ether group, a hydroxyl group, an amino group, an imino group, a cyano group, an amide group, an imide group, an ester group, a sulfone group, and the like.

Examples of the method of chemical processing includes a method of oxidizing by a strong oxide such as a peroxide, by ozone oxidation, by plasma oxidation, or the like; a method of bonding a polymerizing monomer which includes a polar group by graft polymerization; and the like. Due to the chemical processing, the polar group strongly bonds to the molecular chain of the crystalline resin by a covalent bond.

In the present invention, another chargeable material may be applied chemically or physically to the surface of the toner particles. Further, fine particles such as a metal, metallic oxide, metallic salt, ceramic, resin, carbon black, or the like may be added from outside for the purpose of improving chargeability, conductivity, fine particle fluidity, lubricity, or the like.

The volume average particle size of the electrophotographic toner of the present invention is preferably from 1 to 20 $\mu$m, is more preferably from 1 to 15 $\mu$m, and is furthermore preferably from 2 to 8 $\mu$m. Moreover, the number average particle size is preferably from 1 to 20 $\mu$m, is more preferably from 1 to 15 $\mu$m, and is furthermore preferably from 2 to 8 $\mu$m.

The above-described volume average particle size and number average particle size are determined by using, for example, a Colter Counter TA-II model (manufactured by Colter Co.) and measuring with an aperture size of 50 $\mu$m. At this time, the toner is dispersed in an electrolyte aqueous solution (isotone aqueous solution), and is dispersed for 30 seconds or more by ultrasonic waves before the measurement is carried out.

<Preferable Physical Properties of the Electrophotographic Toner of the Present Invention>

It is desirable that the electrophotographic toner of the present invention has sufficient hardness at ordinary temperatures. More specifically, it is desirable that the dynamic viscoelasticity of the toner's at an angular frequency of 1 rad/sec and at 30° C., is such that by a storage modulus $G_L$(30) is $1\times10^6$ Pa or more and a loss modulus $G_N$(30) is $1\times10^6$ Pa or more. It should be noted that details of the storage modulus $G_L$ and the loss modulus $G_N$ are defined in JIS K 6900.

If, at the angular frequency of 1 rad/sec and at 30° C., the storage modulus $G_L$(30) is less than $1\times10^6$ Pa or if the loss modulus $G_N$(30) is less than $1\times10^6$ Pa when the toner is mixed with the carrier within the developing machine, the toner particles will be deformed by pressure or shearing force received from the carrier. As a result, stable charge developing characteristics sometimes could not be maintained. Further, when the toner on the latent image holding material (photorecepter) is cleaned, the toner particles will be deformed by a shearing force which is received from a cleaning blade, such that cleaning defects may be generated When the storage modulus $G_L$(30) and the loss modulus $G_N$ (30), at the angular frequency of 1 rad/sec and at 30° C., fall within the above ranges, even if the toner is used for a high speed electrophotographic apparatus, the characteristics of the toner at the time of fixing are stable, which is preferable.

The electrophotographic toner of the present invention preferably has a melting point within the temperature region of 60 to 120° C. The viscosity of the above specific polyester resin lowers rapidly when the temperature thereof becomes higher than the melting point. As a result, if the specific polyester resin is stored at a temperature higher than the melting point, the toner is aggregated and blocking may be occur. Accordingly, it is preferable that the melting point of the electrophotographic toner of the present invention, which contains the above specific polyester resin as the main component of the binder resin, is a temperature higher than a temperature which the toner is exposed to at a time of storage or at a time of use, i.e., higher than 60° C. On the other hand, if the melting point is higher than 120° C., it may be difficult to achieve the low temperature fixing. The electrophotographic toner of the present invention more preferably has a melting point within the temperature region of 65 to 110° C., and furthermore preferably has a melting point within the temperature region of 70 to 100° C.

The melting point of the electrophotographic toner of the present invention can be determined as a melting peak temperature of an input compensation differential scanning calorimeter, which is described in JIS K 7121. There are cases in which the crystalline resin has a plurality of melting peaks. However, in the present invention, the maximum peak is regarded as the melting point.

Further, it is preferable that the electrophotographic toner of the present invention has temperature interval wherein values of the above storage modulus $G_L$ and the above loss modulus $G_N$ have fluctuations of two digits or more, that is $10^2$ Pa or more, due to the change of the temperature range of 10° C. (when the temperature is raised by 10° C., values of $G_L$ and $G_N$ change to one hundredth of the original values, or smaller). Namely, values of the above storage modulus $G_L$ and the above loss modulus $G_N$ change due to the temperature change by a factor of at least 100 within a certain temperature range of 10° C.

If the above storage modulus $G_L$ and the above loss modulus $G_N$ do not have the above temperature response, the fixing temperature goes up. As a result, toner may be insufficiently fixed at a low temperature and energy consumption may not be reduced in the fixing process.

FIG. 1 is a graph which shows a preferable characteristic of the electrophotographic toner of the present invention. In FIG. 1, a common logarithm of the storage modulus log $G_L$ or a common logarithm of the loss modulus log $G_N$ is denoted on the vertical axis, and a temperature is denoted on the horizontal axis. The elastic modulus of the electrophotographic toner of the present invention having this characteristic lowers rapidly at a melting point in the temperature region of 60 to 120° C. and, further, the elastic modulus is stable within a predetermined range. Accordingly, even if the temperature of the toner is high at the time of fixing, the viscosity thereof does not lower more than necessary. As a result, excessive impregnation of the toner into the transfer material, such as paper or the like, and or generation of an offsets can be prevented.

The method of manufacturing an electrophotographic toner of the present invention which is described above is not limited in particular. However, a method of manufacturing an electrophotographic toner of the present invention which will be described later is particularly preferable. Further, since the above electrophotographic toner of the present invention has the aforementioned structure, the toner has excellent toner blocking resistance, excellent image storability, and excellent low temperature fixability. Moreover, when the above specific polyester resin has a crosslinking structure by an unsaturated bond, in particular, an electrophotographic toner which has a large fixing latitude and good offset resistance and which can satisfactorily prevent excessive impregnation of the toner into a recording material such as paper or the like can be obtained. Still further, improvement of transfer efficiency can be achieved by making the toner particles spherical.

<Two-Component Developer>

The electrophotographic toner of the present invention can be used as a one-component developer without any alteration thereto or as a toner in a two-component developer of the present invention which is formed by a carrier and the toner. The two-component developer of the present invention will be described hereinafter.

A carrier which can be used for the above two-component developer is not limited in particular and any known carrier can be used. Examples of the carrier include a resin coat carrier which has a resin-coated layer on the surface of a core material. Further, the carrier may be a dispersed-type resin coat carrier in which a conductive material is dispersed in a matrix resin.

Examples of the coating resin/matrix resin used for the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride/vinyl acetate copolymer, a styrene/acrylic acid copolymer, a straight silicone resin formed by organosiloxane bonds or a modified product thereof, fluorine contained resins, polyester, polycarbonate, phenol resins, epoxy resins, and the like. However, the coating resin/matrix resin is not limited to the same.

Examples of the conductive material include metals (such as gold, silver, copper, or the like), carbon black, titanium oxide, zinc oxides, barium sulfate, aluminum borate, potassium titanate, tin oxide, and the like. However, the conductive material is not limited to the same.

Further, examples of the core material of the carrier include magnetic metals (such as iron, nickel, cobalt, or the like), magnetic oxides (such as ferrite, magnetite, or the like), glass beads, and the like. In order to use the carrier with a magnetic brushing method, the core material is preferably a magnetic material.

The volume average particle size of the core material of the carrier is generally from 10 to 500 $\mu$m and is preferably from 30 to 100 $\mu$m.

Moreover, in order to resin-coat the surface of the core material of the carrier, there is a method of coating by a coated layer-forming solution, in which the above coating resin and various additives, as necessary, are dissolved in an appropriate solvent. The solvent is not limited in particular and may be selected appropriately in consideration of the coating resin to be used, application suitability, and the like.

Specific examples of the concrete resin coating methods include a submerging method in which the core material of the carrier is submerged in the coated layer-forming solution, a spray method in which the coated layer-forming solution is sprayed on the surface of the core material of the carrier, a fluid bed method in which the coated layer-forming solution is sprayed in a state in which the core material of the carrier is floated by an flow, and a kneader coater method in which the core material of the carrier and the coated layer-forming solution are mixed in a kneader coater and then the solvent is removed.

The mixing ratio (weight ratio) in the above two-component developer between the electrophotographic toner of the present invention and the above-described carrier is within a range of the order of 1:100 to 30:100 and is more preferably within a range of the order of 3:100 to 20:100.

<Image Forming Method>

Next, a description will be given of an image-forming method of the present invention, in which the electrophotographic toner of the present invention or the two-component developer of the present invention is used.

The above-described image-forming method has a latent image forming process in which an electrostatic latent image is formed on the surface of a latent image holding material, a developing process in which the electrostatic latent image formed on the latent image holding material surface is developed using a developer carried by a developer carrying material and in which a toner image is thereby formed, a transferring process in which the toner image formed on the latent image holding material surface is transferred onto the surface of a transfer material such as paper or the like, and a fixing process in which the toner image transferred onto the transfer material surface is subjected to heat fixing. Characteristically, the electrophotographic toner of the present invention or the two-component developer of the present invention is used as the above-mentioned developer.

The developer may be any of a one-component system and a two-component system. In the case of a one-component system, the electrophotographic toner of the present invention is used without any alteration thereto. In the case of a two-component system, the two-component developer of the present invention, in which the above carrier and the electrophotographic toner of the present invention are mixed, is used.

All of the above respective processes in the image-forming method can utilize known processes.

As the above latent image holding material, for example, an electrophotographic photorecepter, a dielectric recording material, or the like can be used.

In the case of the electrophotographic photorecepter, the surface of the electrophotographic photorecepter is charged uniformly by a corotron electrifier, a contact electrifier, or the like and is thereafter exposed such that an electrostatic latent image is formed (the latent image forming process). Next, toner particles are attached to the electrostatic latent image by contacting or approaching a developing roller, on a surface of which a developer layer is formed, and a toner image is formed on the electrophotographic photorecepter (the developing process). The formed toner image is transferred onto the surface of a transfer material such as paper or the like using the corotron electrifier or the like (the transferring process). Further, the toner image which has been transferred onto the surface of the transfer material is subjected to heat fixing by a fixing machine and a final toner image is formed.

At the time of heat fixing by the above fixing machine, in order to prevent offset or the like, a mold releasing agent is usually supplied at a fixing member in the above fixing machine.

In the electrophotographic toner of the present invention ("the toner" includes the case where the toner is included in the two-component developer of the present invention from here on), when there is a crosslinking structure in the binder resin of the toner, mold releasing ability is superior due to an effect thereof. Accordingly, the fixing can be carried out with a reduced amount of the mold releasing agent or without using the mold releasing agent.

From the viewpoint of preventing application of oil to the transfer material and to the image after fixing, it is preferable that the above-described mold releasing agent is not used. However, if the amount of the above mold releasing agent supplied is 0 mg/cm$^2$, when the above fixing member contacts the transfer material such as paper or the like at the time of fixing, the amount of wear of the fixing member may increase, and durability of the fixing member may be reduced. Consequently, in practice, it is preferable that a small amount of the above mold releasing agent is supplied to the fixing member, i.e., the amount used is within a range of $8.0\times10^{-3}$ mg/cm$^2$ or less, If the amount of the above mold releasing agent exceeds $8.0\times10^{-3}$ mg/cm$^2$, the image quality lowers because of mold releasing agent applied to the surface of the image after fixing. In particular, when a light transmission, such as in an OHP is used, this phenomenon may be conspicuousl. Further, as the application of the mold releasing agent to the transfer material becomes conspicuous, the transfer material may become sticky. Moreover, the larger the amount of the above mold releasing agent, the larger the size of a tank which stores the mold releasing agent. Thus, the size of the fixing device itself increases.

The above mold releasing agent is not limited in particular, and examples include liquid mold releasing agents such as dimethyl silicon oil, fluorine containing oil, phlorosilicon oil, denatured oil (such as amino denatured silicon oil or the like), and the like. Of these, from the viewpoint of attaching to the surface of the above fixing member and forming a uniform mold releasing agent layer, a denatured oil such as amino denatured silicon oil or the like has excellent coating ability to the fixing member and is therefore preferable. Further, from the viewpoint of forming a uniform mold releasing agent layer, the fluorine containing oil and the phlorosilicon oil are preferable.

Because an amount of mold releasing agent supplied cannot be reduced in a conventional image-forming method which does not use the electrophotographic toner of the present invention, it is not practical in view of cost to use the fluorine oil or the phlorosilicon oil as a mold releasing agent. However, when the electrophotographic toner of the present invention is used, the amount of the mold releasing agent supplied can be reduced dramatically. Therefore, there is no practical cost problem with using these oils.

A method of supplying the mold releasing agent to the surface of a roller or belt which is a fixing member and is used for the above heating and attaching by pressure is not limited in particular. Examples of the methods include a pad method which uses a pad into which a liquid mold releasing agent has been impregnated, a web method, a roller method, a non-contact type shower method (spray method), and the like. Among them, the web method and the roller method are preferable. When these methods are used, it is advantageous in that the above mold releasing agent can be supplied uniformly and in that it is easy to control the amount supplied. When the above mold releasing agent is supplied to the entire fixing member uniformly by the shower method, it is necessary to use a special blade or the like.

The amount of the mold releasing agent supplied can be measured as follows.

Namely, when plain paper which is used for an ordinary copying machine (typically, a copying paper manufactured by Fuji Xerox Co., Ltd., trade name "J PAPER") is passed through a fixing member in which a mold releasing agent is supplied to the surface, the mold releasing agent is attached to the plain paper. The attached mold releasing agent is extracted using a Soxhlet extractor. Hexane is used for a solvent therein.

An amount of the mold releasing agent included in the hexane is determined by an atomic absorbance analyzing device, and thus the amount of the mold releasing agent attached to the plain paper can be determined. The amount is defined as an amount of the mold releasing agent which is supplied to the fixing member.

Examples of the transfer material onto which the toner image is transferred (recording material) include plain paper, an OHP sheet, and the like, as used in an electrophotographic type copying machine, a printer, or the like.

In order to improve the smoothness of the image surface after the fixing, it is preferable that the surface of the transfer material is as smooth as possible. For example, coated paper in which the surface of a plain paper is coated with a resin or the like, art paper for printing, and the like can be used appropriately.

There is no flocculation of toner in the image-forming method which uses the electrophotographic toner of the present invention. As a result, an image having excellent image quality can be formed, low temperature fixing is possible, and storability of the formed image is excellent. Further, when the binder resin has a crosslinking structure, there is hardly any attachment of the above mold releasing agent to the transfer material. As a result, when an image is formed using a transfer material such as a seal, tape or the like, in which adhesive is applied to a rear side, a seal, sticker or the like on which an image having high image quality and high density is formed can be manufactured.

<Method of Manufacturing Electrophotographic Toner>

A method of manufacturing an electrophotographic toner of the present invention is a method which can be used to produce the above electrophotographic toner of the present invention, and is a wet granulating method.

Examples of the above-described wet granulating method include suitably known methods such as a melting and suspending method, an emulsifying and aggregation method, a dissolving and suspending method, and the like. The emulsifying and aggregation method will be described hereinafter as an example.

The emulsifying and aggregation method has an emulsifying process in which the specific polyester resin, which was described in a section on the "binder resin" in the above "electrophotographic toner" of the present invention, is emulsified and emulsified particles (droplets) are formed; a aggregation process in which an aggregate of the emulsified particles (droplets) is formed; and a coalescence process in which the aggregate is fused and is subjected to heat fusion.

<Emulsifying Process>

In the above emulsifying process, the emulsified particles (droplets) of the specific polyester resin are formed by applying shearing force to a solution in which an aqueous medium is mixed with a mixed solution (polymer solution), which includes a polyester resin which is sulfonated or the like, and a colorant as necessary.

At this time, viscosity of the polymer solution is reduced by heating or by dissolving the polyester resin into an organic solvent, and emulsified particles are thereby formed. Further, in order to stabilize the emulsified particles and increase the viscosity of the aqueous medium, a dispersing agent can be used. The dispersion of the emulsified particles may be hereinafter referred to as "resin particles dispersion".

Examples of the above dispersing agent includes an aqueous polymers such as polyvinyl alcohol, methyl cellulose, ethyl cellulose, hydroxyethyl cellulose, carboxymethyl cellulose, sodium polyacrylate, sodium polymethacrylate, and the like; surfactants (such as an anionic surfactants such as sodium dodecyl benzene sulfonate, sodium octadecyl sulfate, sodium oleate, sodium laurate, potassium stearate, and the like; cationic surfactants such as lauryl amine acetate, stearyl amine acetate, lauryl trimethyl ammonium chloride, and the like; amphoteric ionic surfactants such as lauryl dimethyl amine oxide and the like; nonionic surfactants such as polyoxyethylene alkyl ether, polyoxyethylene alkyl phenyl ether, polyoxyethylene alkyl amine, and the like); inorganic compounds such as tri-calcium phosphate, aluminum hydroxide, calcium sulfate, calcium carbonate, barium carbonate, adn the like; and the like.

When the inorganic compound is used as the dispersing agent, a commercially available product may be used without any alteration thereto. Also, in order to obtain fine particles, a method of generating fine particles of an inorganic compound in a dispersing agent may be used.

An amount of the above dispersing agent used is preferably from 0.01 to 20 parts by weight based on 100 parts by weight of the above polyester resin (binder resin).

In the above emulsifying process, when a dicarboxylic acid having a sulfonic group is copolymerized with the above polyester resin (i.e., a suitable amount of dicarboxylic acid-derived constitutive component having a sulfonic group is included in acid-derived constitutive components), a dispersion stabilizer such as a surfactant or the like can be reduced. Alternatively, emulsified particles can be formed without using the dispersion stabilizer.

Examples of the above organic solvent includes ethyl acetate and toluene, and the organic solvent is selected and used appropriately in accordance with the polyester resin.

An amount of the above organic solvent used is preferably from 50 to 5000 parts by weight, and is more preferably from 120 to 1000 parts by weight, based on 100 parts by weight of the total of the polyester resin and other monomers which are used as necessary (hereinafter, a combination of the polyester resin and the monomers may be referred to simply as "polymer"). Before the emulsified particles are formed, a colorant can be mixed with the organic solvent. Colorants to be used are those which have already been mentioned in the section on the "colorant" of the electrophotographic toner of the present invention.

Examples of an emulsifier which is used when the above emulsified particles are formed includes a homogenizer, a homomixer, a pressurizing kneader, an extruder, a media disperser, and the like. The average particle size (volume average particle size) of the emulsified particles (droplets) of the above polyester resin is preferably from 0.01 to 1 μm, is more preferably from 0.03 to 0.3 μm, and is furthermore preferably from 0.03 to 0.4 μm.

Any general dispersing method using, for example, a rotating shearing type homogenizer, a ball mill having a medium, a sand mill, a DYNO MILL, or the like can be used for a method of dispersing the above colorant. The dispersing method is not limited at all.

As necessary, a water dispersion of these colorants can be prepared using the surfactant, or an organic solvent-dispersion of these colorants can be prepared using the dispersing agent. The dispersion of the colorants may be hereinafter referred to as "coloring particles dispersion". The surfactant or the dispersing agent which is used for dispersion can be the same as the dispersing agent which is used when the above polyester resin is dispersed.

An amount of the above colorant added is preferably from 1 to 20% by weight, is more preferably from 1 to 10% by weight, is furthermore preferably from 2 to 10% by weight, and is particularly preferably from 2 to 7% by weight, based on the total weight of the above polymer.

When the colorant is mixed in the emulsifying process, mixing of the polymer and the colorant can be effected by mixing the colorant or the organic solvent-dispersion of the colorant with the organic solvent-dissolved solution of the polymer.

<Aggregation Process>

In the aggregation process, the obtained emulsified particles are heated and aggregated at a temperature which is in the vicinity of the melting point of the above polyester resin but is lower than the melting point. Accordingly, an aggregate is formed.

Formation of the aggregate of the emulsified particles is carried out by acidifying the pH of an emulsifying solution during stirring. The pH is preferably from 2 to 6, is more preferably from 2.5 to 5, and is furthermore preferably from 2.5 to 4. At this time, it is also effective to use a aggregation agent.

The aggregation agent to be used can suitably be a surfactant which has polarity opposite to that of the surfactant being used as the dispersing agent, an inorganic metallic salt, or a bivalent or more metal complex (a metal complex having valence of at least two). Especially, because the amount of surfactant used can be reduced and charging characteristics improved, it is particularly preferable to use the metal complex.

Examples of the above inorganic metallic salt include a metallic salts such as calcium chloride, calcium nitrate, barium chloride, magnesium chloride, zinc chloride, aluminum chloride, aluminum sulfate, and the like; and inorganic metallic salt polymers such as poly(aluminum chloride), poly(aluminum hydroxide), calcium polysulfide, and the like. Of these, the aluminum salts and the polymers thereof are particularly suitable. In order to obtain a sharper particle distribution, it is suitable that the inorganic metallic salt is bivalent rather than univalent, trivalent rather than bivalent, and tetravalent rather than trivalent, and, if the inorganic metallic salt is a polymerization type inorganic metallic salt polymer, preferable valence number is the same.

<Coalescence Process>

In the coalescence process, progress of flocculation is stopped by changing the pH of a suspension of the aggregate to within the range of 3 to 7 during the same stirring as in the aggregation process. Then, the aggregate is heated and fused at a temperature which is higher than the melting point of the polyester resin.

There are no concerns about the temperature of the above heating provided temperature higher than the melting point of the polyester resin.

The duration of the above heating is approximately a time in which fusion is fully carried out and is of order of from 0.5 to 10 hours.

The fused particles which were obtained by the fusion undergo a solid-liquid separating process such as filtration, a cleaning process, and a drying process, as necessary, and become toner particles. At this time, in order to secure sufficient charging characteristics and reliability of the toner, it is preferable to clean the particles fully in the cleaning process.

In the drying process, any method such as an ordinary vibrating type fluidized drying method, a spray drying method, a freeze drying method, a flash jet method, or the like can be used. The moisture content of the toner particles after the drying is desirably adjusted to 1.0% or less, and is more preferably adjusted to 0.5% or less.

A crosslinking reaction may be effected when the above polyester resin is heated to the melting point or more in the coalescence process, or after the end of the fusion. Further, the crosslinking reaction can be carried out at the same time that the flocculation is carried out. When the crosslinking reaction is implemented, an unsaturated sulfonated crystalline polyester resin which is copolymerized with a double bond component, for example, is used as a binder resin, a radical reaction is caused at the resin, and a crosslinking structure is introduced. At this time, a polymerization initiator which is described below is used.

Examples of the polymerization initiator includes t-butylperoxy-2-ethylhexanoate, cumylperpivalate, t-butylperoxylaurate, benzoylperoxide, lauroylperoxide, octanoylperoxide, di-t-butylperoxide, t-butylcumylperoxide, dicumylperoxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy) 3,3,5-trimethylcyclohexane, 1,1-bis(t-butylperoxy) cyclohexane, 1,4-bis(t-butylperoxycarbonyl) cyclohexane, 2,2-bis(t-butylperoxy) octane, n-butyl 4,4-bis(t-butylperoxy) valate, 2,2-bis(t-butylperoxy) butane, 1,3-bis(t-butylperoxyisopropyl) benzene, 2,5-dimethyl-2,5-di(t-butylperoxy) hexane, 2,5-dimethyl-2,5-di(t-butylperoxy) hexane, 2,5-dimethyl-2,5-di(benzoylperoxy) hexane, di-t-butyldiperoxyisophthalate, 2,2-bis(4,4-di-t-butylperoxycyclohexyl) propane, di-t-butylperoxy α-methylsuccinate, di-t-butylperoxydimethylglutarate, di-t-butylperoxyhexahydroterephthalate, di-t-butylperoxyazelate, 2,5-dimethyl-2,5-di(t-butylperoxy) hexane, diethylene glycol-bis (t-butylperoxycarbonate), di-t-butylperoxytrimethyladipate, tris (t-butylperoxy) triazine, vinyltris (t-butylperoxy) silane, 2,2'-azobis(2-methylpropionamidinedihydrochloride), 2,2'-azobis [N-(2-carboxyethyl)-2-methylpropionamidine], 4,4'-azobis(4-cyanovaleric acid), and the like.

These polymerization initiators can be used alone or in a combination of two or more. An amount and a type of the polymerization initiator is selected in accordance with an amount of unsaturated region in the polymer, and type and amount of a coexisting colorant.

The polymerization initiator may be mixed in advance with the polymer before the emulsifying process or may be introduced into the aggregate during the aggregation process. Further, the polymerization initiator may be introduced during the coalescence process or after the coalescence process. When the polymerization initiator is introduced during the aggregation process, during the coalescence process, or after the coalescence process, a solution in which the polymerization initiator is dissolved or emulsified is added to a particle dispersion (resin particles dispersion or the like). For the purpose of controlling the degree of polymerization, a known crosslinking agent, a chain transfer agent, a polymerization inhibitor, or the like may be added to the polymerization initiator.

In accordance with the above-described method of manufacturing an electrophotographic toner of the present invention, an electrophotographic toner having excellent toner blocking resistance, excellent storability of an image, and excellent low temperature fixability can be provided.

EXAMPLES

The present invention will be described hereinafter in accordance with Examples. However, the present invention is not limited to these Examples.

Example 1

Synthesis of Crystalline Polyester Resin (1)

301 parts by weight of dimethyl terephthalate, 248 parts by weight of 1,9-nonane diol, and 0.3 parts by weight of dibutyl tin oxide as a catalyst are placed into a double necked flask which was dried by heating. Then, air within the container is disposed and made inert atmosphere with nitrogen gas by a reduced pressure operation and the mixed solution is stirred at 180° C. for 5 hours by mechanical stirring.

Thereafter, the temperature is gradually raised to 230° C. under reduced pressure and the mixture is stirred for 2 hours. When the mixture is in a viscous state, the mixture is cooled by air and the reaction is stopped. Accordingly, 340 parts by weight of a crystalline polyester resin (1) (a crystalline polyester resin which includes an acid-derived constitutive component in which the amount of content of an aromatic dicarboxylic acid-derived constitutive component is 100 mole % by constitution, and an alcohol-derived constitutive component in which the amount of content of an aliphatic diol-derived constitutive component is 100 mole % by constitution) is synthesized.

The weight average molecular weight ($M_w$) of the crystalline polyester resin (1) which is obtained in accordance with molecular weight measurement by gel permeation chromatography (polystyrene conversion) is 27500 and the number average molecular weight ($M_n$) thereof is 7200.

Further, the melting point (Tm) of the crystalline polyester resin (1) is measured using a differential scanning calorimeter (DSC) in accordance with the aforementioned measuring method. The melting point has a clear peak and the peak apex temperature is 96° C.

The ester density M is calculated to be 0.095.

Preparation of Electrophotographic Toner (1) (Dissolving and Suspending Method)

28 parts by weight of the crystalline polyester resin (1), 5 parts by weight of a copper phthalocyanine pigment (C.I. pigment blue 15: 3), and 60 parts by weight of toluene are dispersed by a sand mill and thereby a dispersion is prepared.

45 parts by weight of a 40% by weight calcium carbonate suspension and 45 parts by weight of water are added to 36 parts by weight of a 3.0% by weight carboxymethyl cellulose aqueous solution. The entire amount of the dispersion is added to this mixture at 50° C. This mixed solution is stirred and suspended by an emulsifier (trade name: Ultra TURRAX, manufactured by JUNKE & KUNKEL) at 50° C., and 10000 rpm for 3 minutes. Consequently, a suspended solution is obtained.

Next, toluene and water are evaporated as well as possible under a nitrogen gas stream and a crosslinking particles dispersion is obtained. Water in an amount of about five times as much as the crosslinking particles dispersion is added to the obtained crosslinking particles dispersion. The calcium carbonate is dissolved by hydrochloric acid and repeatedly washing with water was carried out. Ultimately, an electrophotographic toner (1) is produced by pressure reduction and freeze drying.

The average particle size of the obtained electrophotographic toner (1) is measured using a Colter Counter [TA-II] model (aperture size: 50 μm, manufactured by Colter Co.). The volume average particle size is 6.5 μm and the number average particle size is 6.1 μm.

Evaluation of Physical Properties of Electrophotographic Toner (1)—Measurement of Viscoelasticity The viscoelasticity of the obtained electrophotographic toner (1) is measured using a rotation plate-type rheometer (manufactured by Rheometric Scientific F. E. Ltd.: RDA, 2RHIOS SYSTEM ver. 4.3.2).

A sample is set in a sample holder. Measurement is carried out at a rate of temperature increase of 1° C./min, a frequency of 1 rad/s, a distortion of 20% or less, and a detection torque within a range of measurement guaranteed values. An 8 mm sample holder or a 20 mm sample holder is used as necessary.

Changes in a storage modulus G' (Pa) and a loss modulus G" (Pa) with respect to the temperature change are obtained. Tables 1 and 3 show a temperature (T1) at which the viscoelasticity dramatically changes by two digits or more (two order of magnitude or more) due to glass transition or polymer melting, values of viscoelasticity ($G_L$, $G_N$) thereat, and a temperature (T2) at which the values of viscoelasticity ($G_L$, $G_N$) are 10000 Pa·S.

Measurement and Evaluation of Fine Particle Aggregating Ability (Toner Blocking Resistance)

A powder tester (Hosokawa Micron Corporation is used and sieves having openings of 53 μm, 45 μm, and 38 μm are disposed in that order from the top. 2 g of the electrophotographic toner (1), which has been weighed accurately, is input to the upper portion of the 53 μm sieve and vibrations are applied to the toner at an amplitude of 1 mm for 90 seconds. After the vibrations, the weights of the toner on the respective sieves are measured, and is multiplied by 0.5 g, 0.3 g, and 0.1 g, respectively. The weighted values are added and calculated as a percentage. The sample (electrophotographic toner (1)) used is left untreated for about 48 hours in an environment of 25° C./50% RH and the measurement is carried out under the environment of 25° C./50% RH. Table 1 shows the result.

In the present invention, regarding the above fine particle aggregating ability, if the amount of the toner after the vibrations is 80% by weight or less, the toner can usually be used without practical problems.

Evaluation of Low Temperature Fixability

Using the obtained electrophotographic toner (1), an image is formed on the surface of recording paper by an A COLOR FULL COLOR COPIER (manufactured by Fuji Xerox Co., Ltd.) wherein a fixing machine has been remodeled, and the low temperature fixability of the electrophotographic toner (1) is evaluated. The evaluation is carried out as follows. The temperature is changed from 80° C. to 120° C. in intervals of 10° C. and a fixed image is formed at each fixing temperature. Thereafter, the image surface of each obtained fixed image is bent V-shaped, and a degree of peeling at the bent portion of the image is observed. The lowest fixing temperature at which the image is hardly peeled is designated MFT (° C.) and the low temperature fixability is evaluated. Table 1 shows the result.

If the above-described fixing temperature is 130° C. or lower, the low temperature fixability can be said to be excellent.

The test conditions of the low temperature fixability are described below.

[Test Conditions]

toner image: solid image (40 mm×50 mm)

amount of toner: 0.9 mg/cm$^2$ recording paper: color copying paper (J PAPER) manufactured by Fuji Xerox Co., Ltd.

conveying speed: 160 mm/sec amount of silicon oil applied: $1.6\times10^{-3}$ mg/cm$^2$ Evaluation of Image Storability Two recording papers, on which the fixed images have been formed at the lowest fixing temperature (MFT (° C.)), are left untreated for 7 days in a state in which the image surfaces are superposed and in which a load of 100 g/cm$^2$ is applied in an environment with a temperature of 60° C. and humidity of 85%. The superposed images are peeled apart, and fusion of the images between the recording papers and transfer of an image to a non-image portion are observed visually. Evaluation is effected in accordance with the following criteria for evaluation. Table 1 shows the result.

Criteria for Evaluation

○: no problem in image storability

Δ: some changes observed, but no practical problem

X: large changes observed, and practically unusable

Evaluation of Chargeability 0.8% by weight of a silica fine particles (hydrophobic silica manufactured by Nippon Aerosil Co.) having a primary particle size of 40 nm which were subjected to surface hydrophobic processing is prepared. 1.0% by weight of metatitanic acid compound fine particles having a primary particle average particle size of 20 nm, which are a reaction product of metatitanic acid and isobutyltrimethoxysilane, (particles in which 100 parts by weight of metatitanic acid and 50 parts by weight of isobutyltrimethoxysilane are processed) is prepared. The silica fine particles and the metatitanic acid compound fine particles are added to and mixed with the electrophotographic toner (1). Thus, an externally added electrophotographic toner (1) is produced.

8 parts by weight of the obtained externally added electrophotographic toner (1) and 92 parts by weight of a methylmethacrylate resin-coated carrier are placed into a V-blender and stirred for 20 minutes. The mixture is placed into a developing machine, the A COLOR FULL COLOR COPIER (manufactured by Fuji Xerox Co., Ltd.). After setup, the amount of the mixture charged is measured by a BLOW-OFF CHARGING AMOUNT MEASURING MACHINE (manufactured by Toshiba Corp.). (A mesh having 20 μm openings is used) Table 1 shows the result.

Example 2

Synthesis of Crystalline Polyester Resin (2)

Except that the amount of dimethyl terephthalate added in "Synthesis of Crystalline Polyester Resin (1)" in Example 1 is changed to 194 parts by weight and that the 248 parts by weight of 1,9-nonane diol therein is replaced with 216 parts by weight of 1,11-undecane diol, 330 parts by weight of a crystalline polyester resin (2) (a crystalline polyester resin which includes an acid-derived constitutive component in which the amount of content of an aromatic dicarboxylic acid-derived constitutive component is 100 mole % by constitution, and an alcohol-derived constitutive component in which the amount of content of a diol-derived constitutive component is 100 mole % by constitution) is synthesized in the same way as in Example 1.

The weight average molecular weight ($M_w$) of the crystalline polyester resin (2) which is obtained in accordance with molecular weight measurement by gel permeation chromatography (polystyrene conversion) is 9300 and the number average molecular weight ($M_n$) thereof is 4400.

Further, the melting point (Tm) of the crystalline polyester resin (2) is measured using the differential scanning calorimeter (DSC) in accordance with the aforementioned measuring method. The melting point has a clear peak and the peak apex temperature is 97° C.

The ester density M is calculated to be 0.087.

Preparation of Electrophotographic Toner (2) (Dissolving and Suspending Method)

Except that the crystalline polyester resin (1) in the "Preparation of Electrophotographic Toner (1) (Dissolving and Suspending Method" in Example 1 is replaced with the crystalline polyester resin (2), an electrophotographic toner (2) is manufactured in the same way as in Example 1. Moreover, the average particle size of the electrophotographic toner (2) is measured in the same way as in Example 1. The volume average particle size is 8.2 μm and the number average particle size is 7.5 μm.

Evaluation of Physical Properties of Electrophotographic Toner (2)

The physical properties of the electrophotographic toner (2) are evaluated in the same way as in "Evaluation of Physical Properties of Electrophotographic toner (1)" in Example 1. Tables 1 and 3 show the results.

Example 3

Synthesis of Crystalline Polyester Resin (3)

Except that the amount of dimethyl terephthalate added in "Synthesis of Crystalline Polyester Resin (1)" in Example 1 is changed to 200 parts by weight, that the amount of 1,9-nonane diol added therein is changed to 188 parts by weight, and that 8.5 parts by weight of dimethyl fumarate, 26 parts by weight of 5-sodium dimethyl sulfoisophthalate and 200 parts by weight of dimethyl sulfoxide are further added, 340 parts by weight of a crystalline polyester resin (3) is synthesized in the same way as in Example 1.

The obtained crystalline resin (3) is measured in accordance with NMR (solvent: dimethyl formamide-d7, TMS standard). In an acid-derived constitutive component, the amount of content of a terephthalic acid (8.1 ppm) derived constitutive component is 87.5 mole % by constitution, the amount of content of a 5-sulfoisophthalic acid (8.5 ppm and 8.6 ppm) derived constitutive component is 7.5 mole % by constitution, and the amount of content of a fumaric acid (6.8 ppm) derived constitutive component is 5 mole % by constitution. In an alcohol-derived constitutive component, the amount of content of a diol-derived constitutive component is 100 mole % by constitution.

The weight average molecular weight ($M_w$) of the crystalline polyester resin (3) which is obtained in accordance with the molecular weight measurement by gel permeation chromatography (polystyrene conversion) is 12500 and the number average molecular weight ($M_n$) thereof is 6100.

Further, the melting point (Tm) of the crystalline polyester resin (3) is measured using the differential scanning calorimeter (DSC) in accordance with the aforementioned measuring method. The melting point has a clear peak and the peak apex temperature is 85° C.

The ester density M is calculated to be 0.096.

Preparation of Electrophotographic Toner (3) (Emulsification and Flocculation)

10 parts by weight of the obtained crystalline polyester resin (3) and 90 parts by weight of distilled water are stirred and emulsified at 95° C., and 10000 rpm for 3 minutes by the emulsifier (Ultra TURRAX). An emulsified solution is thereby obtained.

4 parts by weight of a copper phthalocyanine pigment (C.I. pigment blue 15:3) dispersion (solid content 0.4 parts by weight) is added to 100 parts by weight of the emulsified solution. 10 g of a 1% by weight aluminum sulfate solution is gradually added during stirring to the emulsified solutions, and the flocculation is formed. The mixture containing aggregate is stirred at 60° C. for 2 hours, and then the pH thereof is adjusted to 4.5. Further, the mixture containing aggregate is gradually heated and heat-stirred at 95° C. for 20 minutes. Thereafter, the aggregate is cooled by air, washed with ion-exchange water, and freeze-dried. Accordingly, an electrophotographic toner (3) is fabricated.

The average particle size of the obtained electrophotographic toner (3) is measured using the Colter Counter [TA-II] model (aperture size: 50 μm, manufactured by Colter Co.) in the same way as in Example 1. The volume average particle size is 8.5 μm and the number average particle size is 7.1 μm.

Evaluation of Physical Properties of Electrophotographic Toner (3)

The physical properties of the electrophotographic toner (3) are evaluated in the same way as in "Evaluation of Physical Properties of Electrophotographic toner (1)" in Example 1. Tables 1 and 3 show the results.

Example 4

Preparation of Electrophotographic Toner (4) (Emulsification-Flocculation and Crosslinking)

100 parts by weight of the crystalline polyester (3) having an unsaturated bond, which is obtained in Example 3, and 2.5 parts by weight of lauroyl peroxide are dissolved in 400 parts by weight of tetrahydrofuran. The tetrahydrofuran is removed at 25° C. and 102.5 parts by weight of a polyester resin containing a polymerization initiator is obtained.

10 parts by weight of the obtained polyester resin containing the polymerization initiator and 90 parts by weight of distilled water are stirred and emulsified at 95° C., 10000 rpm for 3 minutes by the emulsifier (Ultra TURRAX). An emulsified solution is thereby obtained.

4 parts by weight of a copper phthalocyanine pigment (C.I. pigment blue 15: 3) dispersion (solid content 0.4 parts by weight) is added to 100 parts by weight of the emulsified solution. 10 g of a 1% by weight aluminum sulfate solution is gradually added while stirring to the emulsified solution and the solution is aggregated. The mixture containing aggregate is stirred at 60° C. for 2 hours, and then the pH thereof is adjusted to 4.5. Further, the aggregate is gradually heated and heat-stirred at 95° C. for 60 minutes. Thereafter, the mixture containing aggregate is cooled by air, washed by ion-exchange water, and freeze-dried. Accordingly an electrophotographic toner (4) is fabricated.

The average particle size of the obtained electrophotographic toner (4) is measured using the Colter Counter [TA-II] model (aperture size: 50 μm, manufactured by Colter Co.) in the same way as in Example 1. The volume average particle size is 9.1 μm and the number average particle size is 7.1 μm.

Evaluation of Physical Properties of Electrophotographic Toner (4)

The physical properties of the electrophotographic toner (4) are evaluated in the same way as in "Evaluation of Physical Properties of Electrophotographic toner (1)" in Example 1. Tables 1 and 3 show the results.

Comparative Example 1

Synthesis of Amorphous Polyester Resin (1)

Except that the amount of dimethyl terephthalate added in "Synthesis of Crystalline Polyester Resin (1)" in Example 1 is changed to 194 parts by weight and that 248 parts by weight of 1,9-nonane diol therein is replaced with 90 parts by weight of 1,3-butane diol, 240 parts by weight of an amorphous polyester resin (1) is synthesized in the same way as in Example 1.

The weight average molecular weight ($M_w$) of the amorphous polyester resin (1), which is obtained in accordance with molecular weight measurement by gel permeation chromatography (polystyrene conversion), is 10400 and the number average molecular weight ($M_n$) thereof is 4800.

Further, DSC spectrum of the amorphous polyester resin (1) is measured using the differential scanning calorimeter (DSC) in the same way as in the aforementioned measurement of the melting point. A clear peak is not presented and a step-formed change in an endothermic amount is observed. A glass transition point, at an intermediate point of the step-formed change in endothermic amount is 49° C.

The ester density M is calculated to be 0.133.

Preparation of Electrophotographic Toner (5) (Dissolving and Suspending Method)

28 parts by weight of the obtained amorphous polyester resin (1), 5 parts by weight of a copper phthalocyanine pigment (C.I. pigment blue 15:3), and 60 parts by weight of ethyl acetate are dispersed by a sand mill and thereby a dispersion is prepared.

45 parts by weight of a 40% by weight calcium carbonate suspension and 45 parts by weight of water are added to 36 parts by weight of a 3.0% by weight carboxymethyl cellulose aqueous solution. The above dispersion is added to this mixture at 50° C., and this mixed solution is stirred and suspended at 50° C., and 10000 rpm by the emulsifier (Ultra TURAXX) for 3 minutes. Consequently, a suspended solution is obtained. Next, ethyl acetate and water are evaporated as well as possible under a nitrogen gas stream and a crosslinking particles dispersion is obtained. Thereafter, water in an amount of about five times as much as the crosslinking particles dispersion is added to the obtained crosslinking particles dispersion. The calcium carbonate is dissolved by hydrochloric acid and repeated washing with water is carried out. Ultimately, an electrophotographic toner (5) is fabricated by pressure reduction and freeze drying.

The average particle size of the obtained electrophotographic toner (5) is measured using the Colter Counter [TA-II] model (aperture size: 50 μm, manufactured by Colter Co.) in the same way as in Example 1. The volume average particle size is 7.7 μm and the number average particle size is 6.1 μm.

Evaluation of Physical Properties of Electrophotographic Toner (5)

The physical properties of the electrophotographic toner (5) are evaluated in the same way as in "Evaluation of Physical Properties of Electrophotographic toner (1)" in Example 1. Tables 1 and 3 show the results.

Comparative Example 2

Synthesis of Amorphous Polyester Resin (2)

35 mole parts of polyoxyethylene (2,0)-2,2-bis(4-hydroxyphenyl) propane, 65 mole parts of polyoxypropylene (2,2)-2,2-bis(4-hydroxyphenyl) propane, 80 mole parts of terephthalic acid, 10 mole parts of n-dodecenyl succinate, 10 mole parts of trimellitic acid, and 0.05 mole parts with respect to these acid components (the total molar number of terephthalic acid, n-dodecenyl succinate, and trimellitic acid) of dibutyl tin oxide are placed into a double necked flask which was dried by heating. Then, nitrogen gas is introduced into the container, such that the atmosphere in the container is kept inert, and the temperature is raised. Thereafter, the mixture is subjected to copolycondensation at a temperature of from 150 to 230° C. for about 12 hours. Then, the pressure is gradually reduced at a temperature of from 210 to 250° C. Accordingly, an amorphous polyester resin (2) is synthesized.

The weight average molecular weight ($M_w$) of the amorphous polyester resin (2), which is obtained in accordance with molecular weight measurement by gel permeation chromatography (polystyrene conversion), is 15400 and the number average molecular weight ($M_n$) thereof is 6800.

Further, the DSC spectrum of the amorphous polyester resin (2) is measured using the differential scanning calorimeter (DSC) in the same way as in the aforementioned measurement of the melting point. A clear peak is not presented and a step-formed change in endothermic amount is observed. A glass transition point, at an intermediate point of the step-formed change in endothermic amount, is 65° C.

The ester density M is calculated to be 0.067.

Preparation of Electrophotographic Toner (6) (Dissolving and Suspending Method)

86 parts by weight of the obtained amorphous polyester resin (2), and 16 parts by weight of a copper phthalocyanine pigment (C.I. pigment blue 15:3) are melted and mixed using a Banbury type mixer. A coloring resin composition having a high density is obtained. 25 parts by weight of the coloring resin composition and 75 parts by weight of the amorphous polyester resin (2) are dispersed and dissolved in 100 parts by weight of ethyl acetate. A dispersion is thereby prepared.

The obtained dispersion is added to a mixed solution of 1 part by weight of carboxymethyl cellulose, 20 parts by weight of calcium carbonate, and 100 parts by weight of water, and this mixture is stirred and dispersed at high speed by a mixer. An emulsified solution is thereby obtained. The emulsified solution is placed into a beaker and water having an amount of about five times as much as that of the emulsified solution is added thereto. The mixture is held in a warm bath at 45° C. for 10 hours during stirring and the above ethyl acetate is evaporated. The calcium carbonate is dissolved by hydrochloric acid and repeated washing with water is carried out. Thus, a mixture of water and toner is obtained. Ultimately, water is evaporated by a freeze dryer and an electrophotographic toner (6) is manufactured.

The average particle size of the obtained electrophotographic toner (6) is measured using the Colter Counter [TA-II] model (aperture size: 50 $\mu$m, manufactured by Colter Co.) in the same way as in Example 1. The volume average particle size is 7.9 $\mu$m and the number average particle size is 7.3 $\mu$m.

Evaluation of Physical Properties of Electrophotographic Toner (6)

The physical properties of the electrophotographic toner (6) are evaluated in the same way as in "Evaluation of Physical Properties of Electrophotographic toner (1)" in Example 1. Tables 1 and 3 show the results.

Example 5

Synthesis of Crystalline Polyester Resin (4)

17.4 parts by weight of 1,10-decane diol, 2.2 parts by weight of 5-sodium dimethyl sulfoisophthalate, 10 parts by weight of dimethyl sulfoxide, and 0.03 parts by weight of dibutyl tin oxide as a catalyst are placed into a three necked flask which was dried by heating. Then, air within the container is disposed and made inert atmosphere with nitrogen gas by a reduced pressure operation, and the mixed solution is stirred at 180° C. for 3 hours by mechanical stirring. Under the reduced pressure, dimethyl sulfoxide is removed by distillation. Under a nitrogen air stream, 26.5 parts by weight of dimethyl dodecane dioic acid is added to the mixture, and the mixture is stirred at 180° C. for 1 hour.

Thereafter, the temperature is gradually increased to 220° C. under reduced pressure and the mixture is stirred for 30 minutes. When the mixture is in a viscous state, the mixture is cooled by air and the reaction is stopped. Accordingly, 36 parts by weight of a crystalline polyester resin (4) is synthesized.

The weight average molecular weight ($M_w$) of the crystalline polyester resin (4), which is obtained in accordance with molecular weight measurement by gel permeation chromatography (polystyrene conversion), is 9200 and the number average molecular weight ($M_n$) thereof is 6000.

Further, the melting point (Tm) of the crystalline polyester resin (4) is measured using the differential scanning calorimeter (DSC) in accordance with the aforementioned measuring method. The melting point has a clear peak and the peak apex temperature is 79° C.

The content ratio of the copolymerization component (5-sulfoisophthalic acid component) to the dodecane dioic acid component which is measured from the NMR spectrum of the resin is 7.5:92.5.

The ester density M is calculated to be 0.078.

Preparation of Electrophotographic Toner (7) (Emulsifying and Aggregation Method)

<Preparation of Resin Particles Dispersion (1)>

150 parts by weight of the obtained crystalline polyester resin (4) is placed into 850 parts by weight of distilled water. While being heated at 85° C., the mixture is mixed and stirred with a homogenizer (manufactured by IKA Japan Co.; Ultra TURRAX). Accordingly, resin particles dispersion (1) is obtained.

<Preparation of Colorant Dispersion (1)>

250 parts by weight of phthalocyanine pigment (manufactured by Dainichiseika Color & Chemicals mfg. Co., Ltd.: PV FAST BLUE), 20 parts by weight of anionic surfactant (manufactured by Dai-ichi Kogyo Seiyaku Inc.: NEOGEN RK), and 730 parts by weight of ion-exchange water are mixed and dissolved. Thereafter, the mixture is dispersed using the homogenizer (manufactured by IKA Japan Co.; Ultra TURRAX). Consequently, a colorant dispersion (1) which is formed by dispersing the colorant (phthalocyanine pigment) is prepared.

<Preparation of Aggregated Particles>

2400 parts by weight of the resin particles dispersion (1), 100 parts by weight of the colorant dispersion (1), 63 parts by weight of a mold releasing agent particles dispersion, 10 parts by weight of lauroyl peroxide, 5 parts by weight of aluminum sulfate (manufactured by Wako Pure Chemical Industries, Ltd.), and 100 parts by weight of ion-exchange water are accommodated within a stainless round flask. The pH of this mixture is adjusted to 2.0, and then the mixture is dispersed using a homogenizer (manufactured by IKA Co.: Ultra TURRAX T50). Then, the mixture is heated during stirring up to 74° C. in an oil bath for heating. The mixture is held at 74° C. for 3 hours and is then observed with a light microscope. It is verified that aggregated particles having an average particle size of about 6.5 μm have been formed. Further, the mixture is held at 74° C. by heating and stirring for 1 hour and then is observed by the light microscope. It is verified that aggregated particles having an average particle size of about 7.3 μm have been formed.

<Coalescence Process>

The pH of the mixture containing aggregated particles is 2.4. An aqueous solution in which sodium carbonate (manufactured by Wako Pure Chemical Industries, Ltd.) is diluted to 0.5% by weight is added to the mixture containing aggregated particles gently. Accordingly, the pH of the mixed solution is adjusted to 5.0. Then, the mixed solution is heated to 83° C. while being stirred continuously and is held thereat for 3 hours.

Thereafter, the reaction product is filtered and washed sufficiently with ion-exchange water, and is then dried using a vacuum dryer. Accordingly, electrophotographic toner (7) is obtained.

The average particle size of the obtained electrophotographic toner (7) is measured using the Colter Counter [TA-II] model (aperture size: 50 μm, manufactured by Colter Co.). The average particle size is 7.5 μm.

Evaluation of Physical Properties of Electrophotographic Toner (7)

The physical properties of the electrophotographic toner (7) are evaluated in the same way as in "Evaluation of Physical Properties of Electrophotographic toner (1)" in Example 1. Tables 2 and 3 show the results.

Example 6

Synthesis of Crystalline Polyester Resin (5)

18.9 parts by weight of 1,20-eicosane diol, 1.3 parts by weight of 5-sodium dimethyl sulfoisophthalate, 10 parts by weight of dimethyl sulfoxide, and 0.03 parts by weight of dibutyl tin oxide as a catalyst are placed into a three necked flask which was dried by heating. Then, air within the container is disposed and made inert atmosphere with nitrogen gas by a reduced pressure operation and this mixed solution is stirred at 180° C. for 3 hours by mechanical stirring. Under this reduced pressure, dimethyl sulfoxide is removed by distillation. Under a nitrogen air stream, 15.9 parts by weight of dimethyl dodecane dioic acid is added to the mixture and the mixture, is stirred at 180° C. for 1 hour.

Thereafter, the temperature is gradually increased to 220° C. under reduced pressure and the mixture is stirred for 30 minutes. When the mixture is in a viscous state, the mixture is cooled by air and the reaction is stopped. Accordingly, 33 parts by weight of a crystalline polyester resin (5) is synthesized.

The weight average molecular weight ($M_w$) of the crystalline polyester resin (5), which is obtained in accordance with molecular weight measurement by gel permeation chromatography (polystyrene conversion), is 10200 and the number average molecular weight ($M_n$) thereof is 6100.

Further, the melting point (Tm) of the crystalline polyester resin (5) is measured using the differential scanning calorimeter (DSC) in accordance with the aforementioned measuring method. The melting point has a clear peak and the peak apex temperature is 93° C.

The content ratio of the copolymerization component (5-sulfoisophthalic acid component) to the decane dioic acid component, which is measured and calculated from the NMR spectrum of the resin, is 7.7:92.3.

The ester density M is calculated to be 0.056.

Preparation of Electrophotographic Toner (8) (Emulsifying and Aggregation Method)

<Preparation of Resin Particles Dispersion (2)>

150 parts by weight of the crystalline polyester resin (5) is placed into 850 parts by weight of distilled water. During heating at 99° C., the mixture is mixed and stirred in a homogenizer (manufactured by IKA Japan Co.; Ultra TURRAX). Accordingly, a resin particles dispersion (2) is obtained.

<Preparation of Aggregated Particles>

2400 parts by weight of the resin particles dispersion (2), 100 parts by weight of the colorant dispersion (1) which is obtained in Example 5, 63 parts by weight of a mold releasing agent particles dispersion, 10 parts by weight of lauroyl peroxide, 5 parts by weight of aluminum sulfate (manufactured by Wako Pure Chemical Industries, Ltd.), and 100 parts by weight of ion-exchange water are accommodated within a stainless round flask. The pH of this mixture is adjusted to 2.0, and then the mixture is dispersed using a homogenizer (manufactured by IKA Co.: Ultra TURRAX T50). Then, the mixture is heated during stirring up to 90° C. in an oil bath for heating. The mixture is held at 91° C. for 3 hours and is then observed with a light microscope. It is verified that aggregated particles having an average particle size of about 6.1 μm have been formed. Further, the mixture is held at 91° C. by heating and stirring for 1 hour and then is observed by the light microscope. It is verified that the aggregated particles having an average particle size of about 7.3 μm have been formed.

<Coalescence Process>

The pH of the mixture containing aggregated particles is 2.4. An aqueous solution in which sodium carbonate (manufactured by Wako Pure Chemical Industries, Ltd.) is diluted to 0.5% by weight is added to the mixture containing aggregated particles gently. Accordingly, the pH of the mixed solution is adjusted to 5.0. Then, the mixed solution is heated to 97° C. while being stirred continuously and is held thereat for 3 hours.

Thereafter, the reaction product is filtered and washed sufficiently with ion-exchange water, and is then dried using a vacuum dryer. Consequently, electrophotographic toner (8) is obtained.

The average particle size of the obtained electrophotographic toner (8) is measured using the Colter Counter [TA-II] model (aperture size: 50 μm, manufactured by Colter Co.). The average particle size is 7.5 μm.

Evaluation of Physical Properties of Electrophotographic Toner (8)

The physical properties of the electrophotographic toner (8) are evaluated in the same way as in "Evaluation of Physical Properties of Electrophotographic toner (1)" in Example 1. Tables 2 and 3 show the results.

Example 7

Synthesis of Crystalline Polyester Resin (6)

37.8 parts by weight of 1,20-eicosane diol, 2.7 parts by weight of 5-sodium dimethyl sulfoisophthalate, 20 parts by weight of dimethyl sulfoxide, and 0.07 parts by weight of dibutyl tin oxide as a catalyst are placed into a three necked flask which was dried by heating. Then, air within the container is disposed and made inert atmosphere with nitrogen gas by a reduced pressure operation and the mixed solution is stirred at 180° C. for 3 hours by mechanical stirring. Under the reduced pressure, dimethyl sulfoxide is removed by distillation. Under a nitrogen air stream, 38.9 parts by weight of dimethyl eicosane dioic acid is added to the mixture and the mixture, is stirred at 180° C. for 1 hour.

Thereafter, the temperature is gradually increased to 220° C. under reduced pressure and the mixture is stirred for 30 minutes. When the mixture is in a viscous state, the mixture is cooled by air and the reaction is stopped. Accordingly, 72 parts by weight of a crystalline polyester resin (6) is synthesized. Because the obtained crystalline polyester resin (6) is insoluble in tetrahydrofuran, measurement of the molecular weight could not be carried out.

Further, the melting point (Tm) of the crystalline polyester resin (6) is measured using the differential scanning calorimeter (DSC) in accordance with the aforementioned measuring method. The melting point has a clear peak and the peak apex temperature is 100° C.

The content ratio of the copolymerization component (5-sulfoisophthalic acid component) to the eicosane dioic acid component, which is measured and calculated from the NMR spectrum of the resin, is 7.5:92.5.

The ester density M is calculated to be 0.044.

Preparation of Electrophotographic Toner (9) (Emulsifying and Aggregation Method)

<Preparation of Resin Particles Dispersion (3)>

150 parts by weight of the crystalline polyester resin (6) is placed into 850 parts by weight of distilled water. During heating at 100° C., the mixture is mixed and stirred using a homogenizer (manufactured by IKA Japan Co.; Ultra TURRAX). Accordingly, a resin particles dispersion (3) is obtained.

<Preparation of Aggregated Particles>

2400 parts by weight of the resin particles dispersion (3), 100 parts by weight of the colorant dispersion (1) which is obtained in Example 5, 63 parts by weight of a mold releasing agent particles dispersion, 10 parts by weight of lauroyl peroxide, 5 parts by weight of aluminum sulfate (manufactured by Wako Pure Chemical Industries, Ltd.), and 100 parts by weight of ion-exchange water are accommodated within a stainless round flask. The pH of this mixture is adjusted to 2.0. Then, the mixture is dispersed using a homogenizer (manufactured by IKA Co.: Ultra TURRAX T50), and is heated during stirring up to 92° C. in an oil bath for heating. The mixture is held at 92° C. for 3 hours and is then observed with a light microscope. It is verified that aggregated particles having an average particle size of about 6.4 $\mu$m have been formed. Further, the mixture is held at 92° C. by heating and stirring for 1 hour and then is observed by the light microscope. It is verified that aggregated particles having an average particle size of about 7.3 $\mu$m have been formed.

<Coalescence Process>

The pH of the mixture containing aggregated particles is 2.4. An aqueous solution in which sodium carbonate (manufactured by Wako Pure Chemical Industries, Ltd.) is diluted to 0.5% by weight is added to the mixture containing aggregated particles gently. Accordingly, the pH of the mixed solution is adjusted to 5.0. Then, the mixed solution is heated to 100° C. while stirring continuously and is held thereat for 3 hours.

Thereafter, the reaction product is filtered and washed sufficiently with ion-exchange water, and is then dried using a vacuum dryer. Consequently, electrophotographic toner (9) is obtained.

The average particle size of the obtained electrophotographic toner (9) is measured using the Colter Counter [TA-II ] model (aperture size: 50 $\mu$m, manufactured by Colter Co.). The average particle size is 7.5 $\mu$m.

Evaluation of Physical Properties of Electrophotographic Toner (9)

The physical properties of the electrophotographic toner (9) are evaluated in the same way as in "Evaluation of Physical Properties of Electrophotographic toner (1)" in Example 1. Tables 2 and 3 show the results.

Example 8

Synthesis of Crystalline Polyester Resin (7)

40 parts by weight of dimethyl sebacate, 32.8 parts by weight of 1,10-decane diol, 4.2 parts by weight of 5-sodium dimethyl sulfoisophthalate, 27 parts by weight of dimethyl sulfoxide, and 0.03 parts by weight of dibutyl tin oxide as a catalyst are placed into a three necked flask which was dried by heating. Then, air within the container is disposed and made inert atmosphere with nitrogen gas by a reduced pressure operation and the mixed solution is stirred at 180° C. for 5 hours by mechanical stirring. Under the reduced pressure, dimethyl sulfoxide is removed by distillation. Thereafter, the temperature is gradually increased to 220° C. under reduced pressure and the mixture is stirred for 2 hours. When the mixture is in a viscous state, the mixture is cooled by air and the reaction is stopped. Accordingly, 65 parts by weight of a crystalline polyester resin (7) is synthesized.

The weight average molecular weight ($M_w$) of the crystalline polyester resin (7), which is obtained in accordance with molecular weight measurement by gel permeation chromatography (polystyrene conversion), is 6800 and the number average molecular weight ($M_n$) thereof is 3600.

Further, the melting point (Tm) of the crystalline polyester resin (7) is measured using a differential scanning calorimeter (DSC) in accordance with the aforementioned measuring method. The melting point has a clear peak and the peak apex temperature is 75° C.

The content ratio of the copolymerization component (5-sulfoisophthalic acid component) to the sebacic acid component, which is measured from the NMR spectrum of the resin, is 7.5:92.5.

The ester density M is calculated to be 0.084.

Preparation of Electrophotographic Toner (10) (Emulsifying and Aggregation Method)

<Preparation of Resin Particles Dispersion (4)>

150 parts by weight of the crystalline polyester resin (7) is placed into 850 parts by weight of distilled water. During heating at 85° C., the mixture is mixed and stirred using a homogenizer (manufactured by IKA Japan Co.; Ultra TURRAX). Accordingly, a resin particles dispersion (4) is obtained.

<Preparation of Aggregated Particles>

2400 parts by weight of the resin particles dispersion (4), 100 parts by weight of the colorant dispersion (1) which is obtained in Example 5, 63 parts by weight of a mold releasing agent particles dispersion, 10 parts by weight of lauroyl peroxide, 5 parts by weight of aluminum sulfate (manufactured by Wako Pure Chemical Industries, Ltd.), and 100 parts by weight of ion-exchange water are accommodated within a stainless round flask. The pH of the mixture is adjusted to 2.0, and then, the mixture is dispersed using a homogenizer (manufactured by IKA Co.: Ultra TURRAX T50). Then, the mixture is heated during stirring up to 70° C. in an oil bath for heating. The mixture is held at 70° C. for 3 hours and is then observed with a light microscope. It is verified that aggregated particles having an average particle size of about 5.9 $\mu$m have been formed. Further, the mixture is held at 70° C. by heating and stirring for 1 hour and then is observed by the light microscope. It is verified that aggregated particles having an average particle size of about 7.0 $\mu$m have been formed.

<Coalescence Process>

The pH of the mixture containing aggregated particles is 2.4. An aqueous solution in which sodium carbonate (manufactured by Wako Pure Chemical Industries, Ltd.) is diluted to 0.5% by weight is added to the aggregated particles gently. Accordingly, the pH of the mixed solution is adjusted to 5.0. Then, the mixed solution is heated to 80° C. while being stirred continuously and is held thereat for 3 hours.

Thereafter, the reaction product is filtered and washed sufficiently with ion-exchange water, and is then dried using a vacuum dryer. Consequently, an electrophotographic toner (10) is obtained.

The average particle size of the obtained electrophotographic toner (10) is measured using the Colter Counter [TA-II] model (aperture size: 50 μm, manufactured by Colter Co.). The average particle size is 7.2 μm.

Evaluation of Physical Properties of Electrophotographic Toner (10)

The physical properties of the electrophotographic toner (10) are evaluated in the same way as in "Evaluation of Physical Properties of Electrophotographic toner (1)" in Example 1. Tables 2 and 3 show the results.

Comparative Example 3

Synthesis of Crystalline Polyester Resin (8)

124 parts by weight of ethylene glycol, 22.2 parts by weight of 5-sodium dimethyl sulfoisophthalate, 213 parts by weight of dimethyl sebacate, and 0.3 parts by weight of dibutyl tin oxide as a catalyst are placed into a three necked flask which was dried by heating. Then, air within the container is disposed and made inert atmosphere with nitrogen gas by a reduced pressure operation and this mixed solution is stirred at 180° C. for 5 hours by mechanical stirring. Thereafter, the temperature is gradually increased to 220° C. under reduced pressure and the mixture is stirred for 2 hours. When the mixture is in a viscous state, the mixture is cooled by air and the reaction is stopped. Accordingly, 220 parts by weight of a crystalline polyester resin (8) is synthesized.

The weight average molecular weight ($M_w$) of the crystalline polyester resin (8), which is obtained in accordance with molecular weight measurement by gel permeation chromatography (polystyrene conversion), is 11000 and the number average molecular weight ($M_n$) thereof is 4700.

Further, the melting point (Tm) of the crystalline polyester resin (8) is measured using the differential scanning calorimeter (DSC) in accordance with the aforementioned measuring method. The melting point has a clear peak and the peak apex temperature is 69° C.

The content ratio of the copolymerization component (5-sulfoisophthalic acid component) to the sebacic acid component, which is measured from the NMR spectrum of the resin, is 7.5:92.5.

The ester density M is calculated to be 0.126.

Preparation of Electrophotographic Toner (11) (Emulsifying and Aggregation Method)

<Preparation of Resin Particles Dispersion (5)>

150 parts by weight of the obtained crystalline polyester resin (8) is placed into 850 parts by weight of distilled water. During heating at 80° C., the mixture is mixed and stirred in a homogenizer (manufactured by IKA Japan Co.; Ultra TURRAX). Accordingly, a resin particles dispersion (5) is obtained.

<Preparation of Aggregated Particles>

2400 parts by weight of the resin particles dispersion (5), 100 parts by weight of the colorant dispersion (1) which is obtained in Example 5, 63 parts by weight of a mold releasing agent particles dispersion, 10 parts by weight of lauroyl peroxide, 5 parts by weight of aluminum sulfate (manufactured by Wako Pure Chemical Industries, Ltd.), and 100 parts by weight of ion-exchange water are accommodated within a stainless round flask. The pH of the mixture is adjusted to 2.0. Then, the mixture is dispersed using a homogenizer (manufactured by IKA Co.: Ultra TURRAX T50). Then, the mixture is heated during stirring up to 65° C. in an oil bath for heating. The mixture is held at 65° C. for 3 hours and is then observed with a light microscope. It is verified that aggregated particles having an average particle size of about 6.0 μm have been formed. Further, the mixture is held at 65° C. by heating and stirring for 1 hour and then is observed by the light microscope. It is verified that aggregated particles having an average particle size of about 7.8 μm have been formed.

<Coalescence Process>

The pH of the aggregated particles is 2.4. An aqueous solution in which sodium carbonate (manufactured by Wako Pure Chemical Industries, Ltd.) is diluted to 0.5% by weight is added to the mixture containing aggregated particles gently. The pH of the mixed solution is adjusted to 5.0. Then, the mixed solution is heated to 75° C. while being stirred continuously and is held thereat for 3 hours.

Thereafter, the reaction product is filtered and washed sufficiently with ion-exchange water, and is then dried using a vacuum dryer. Accordingly, an electrophotographic toner (11) is obtained.

The average particle size of the obtained electrophotographic toner (11) is measured using the Colter Counter [TA-II] model (aperture size: 50 μm, manufactured by Colter Co.). The average particle size is 7.9 μm.

Evaluation of Physical Properties of Electrophotographic Toner (11)

The physical properties of the electrophotographic toner (11) are evaluated in the same way as in "Evaluation of Physical Properties of Electrophotographic toner (1)" in Example 1. Tables 2 and 3 show the results.

Comparative Example 4

Synthesis of Crystalline Polyester Resin (9)

90.1 parts by weight of 1,4-butane diol, 22.2 parts by weight of 5-sodium dimethyl sulfoisophthalate, 161.1 parts by weight of dimethyl adipate, and 0.3 parts by weight of dibutyl tin oxide as a catalyst are placed into a three necked flask which was dried by heating. Then, air within the container is disposed and made inert atmosphere with nitrogen gas by a reduced pressure operation and the mixed solution is stirred at 180° C. for 5 hours by mechanical stirring. Thereafter, the temperature is gradually increased to 220° C. under reduced pressure and the mixture is stirred for 2 hours. When the mixture is in a viscous state, the mixture is cooled by air and the reaction is stopped. Accordingly, 220 parts by weight of a crystalline polyester resin (9) is synthesized.

The weight average molecular weight ($M_w$) of the crystalline polyester resin (9), which is obtained in accordance with molecular weight measurement by gel permeation chromatography (polystyrene conversion), is 11000 and the number average molecular weight ($M_n$) thereof is 4700.

Further, the melting point (Tm) of the crystalline polyester resin (9) is measured using the differential scanning calorimeter (DSC) in accordance with the aforementioned measuring method. The melting point has a clear peak and the peak apex temperature is 55° C.

The content ratio of the copolymerization component (5-sulfoisophthalic acid component) to the adipic acid component, which is measured from the NMR spectrum of the resin, is 7.5:92.5.

The ester density M is calculated to be 0.141.

Preparation of Electrophotographic Toner (12) (Emulsifying and Aggregation Method)

<Preparation of Resin Particles Dispersion (6)>

150 parts by weight of the crystalline polyester resin (9) is placed into 850 parts by weight of distilled water. While heating at 70° C., the mixture is mixed and stirred in a homogenizer (manufactured by IKA Japan Co.; Ultra TURRAX). Accordingly, a resin particles dispersion (6) is obtained.

<Preparation of Aggregated Particles>

2400 parts by weight of the resin particles dispersion (6), 100 parts by weight of the colorant dispersion (1) which is obtained in Example 5, 63 parts by weight of a mold releasing agent particles dispersion, 10 parts by weight of lauroyl peroxide, 5 parts by weight of aluminum sulfate (manufactured by Wako Pure Chemical Industries, Ltd.), and 100 parts by weight of ion-exchange water are accommodated within a stainless round flask. The pH of this mixture is adjusted to 2.0. Then, the mixture is dispersed using a homogenizer (manufactured by IKA Co.: Ultra TURRAX T50). Then, the mixture is heated during stirring up to 52° C. in an oil bath for heating. The mixture is held at 52° C. for 3 hours and is then observed with a light microscope. It is verified that aggregated particles having an average particle size of about 6.2 μm have been formed. Further, the mixture is held at 52° C. by heating and stirring for 1 hour and then is observed by the light microscope. It is verified that aggregated particles having an average particle size of about 7.5 μm have been formed.

<Coalescence Process>

The pH of the mixture containing aggregated particles is 2.4. An aqueous solution in which sodium carbonate (manufactured by Wako Pure Chemical Industries, Ltd.) is diluted to 0.5% by weight is added to the mixture containing aggregated particles gently. The pH of this mixed solution is adjusted to 5.0. Then, the mixed solution is heated to 65° C. while being stirred continuously and is held thereat for 3 hours.

Thereafter, a reaction product is filtered and washed sufficiently with ion-exchange water, and is then dried using a vacuum dryer. Accordingly, an electrophotographic toner (12) is obtained.

The average particle size of the obtained electrophotographic toner (12) is measured using the Colter Counter [TA-II] model (aperture size: 50 μm, manufactured by Colter Co.). The average particle size is 7.8 μm.

Evaluation of Physical Properties of Electrophotographic Toner (12)

The physical properties of the electrophotographic toner (12) are evaluated in the same way as in "Evaluation of Physical Properties of Electrophotographic toner (1)" in Example 1. Tables 2 and 3 show the results.

TABLE 1

| Example | | Example 1 | Example 2 | Example 3 | Example 4 | C. E. 1 | C. E. 2 |
|---|---|---|---|---|---|---|---|
| Electrophotographic Toner | | E. T. (1) | E. T. (2) | E. T. (3) | E. T. (4) | E. T. (5) | E. T. (6) |
| Ester Density M | | 0.095 | 0.087 | 0.096 | 0.096 | 0.133 | 0.067 |
| Viscoelasticity (Sharp Meltability) | T1 (° C.) | 95 | 96 | 82 | 82 | 47 | 63 |
| | T2 (° C.) | 97.5 | 98 | 85 | 85 | 99 | 115 |
| Fine Particle Aggregating Ability (% by weight) | | 60 | 45 | 50 | 50 | 100 | 50 |
| Low Temperature of Fixability (MFT) (° C.) | | 130 | 130 | 120 | 120 | 140 | 160 |

TABLE 1-continued

| Example | Example 1 | Example 2 | Example 3 | Example 4 | C. E. 1 | C. E. 2 |
|---|---|---|---|---|---|---|
| Image Storability | ○ | ○ | ○ | ○ | x | Δ |
| Chargeability (Amount Charged: −μC/g) | 23 | 25 | 22 | 20 | 6 | 25 |

*C. E. = Comparative Example
*E. T. = Electrophotographic Toner

TABLE 2

| Example | | Example 5 | Example 6 | Example 7 | Example 8 | C. E. 3 | C. E. 4 |
|---|---|---|---|---|---|---|---|
| Electrophotographic Toner | | E. T. (7) | E. T. (8) | E. T. (9) | E. T. (10) | E. T. (11) | E. T. (12) |
| Ester Density M | | 0.078 | 0.056 | 0.044 | 0.084 | 0.126 | 0.141 |
| Viscoelasticity (Sharp Meltability) | T1 (° C.) | 76 | 88 | 95 | 72 | 67 | 54 |
| | T2 (° C.) | 78 | 90 | 96 | 74 | 68 | 55 |
| Fine Particle Aggregating Ability (% by weight) | | 56 | 50 | 40 | 55 | 60 | 65 |
| Low Temperature of Fixability (MFT) (° C.) | | 110 | 120 | 130 | 100 | 90 | 80 |
| Image Storability | | ○ | ○ | ○ | ○ | ○ | x |
| Chargeability (Amount Charged: −μC/g) | | 26 | 29 | 36 | 20 | 11 | 6 |

*C. E. = Comparative Example
*E. T. = Electrophotographic Toner

TABLE 3

| | $G_L$(Pa) at 30° C. | $G_N$(Pa) at 30° C. | $G_L$(Pa) at T1 | $G_N$(Pa) at T1 |
|---|---|---|---|---|
| Example 1 | $9 \times 10^7$ | $4 \times 10^7$ | $8 \times 10^7$ | $1.2 \times 10^6$ |
| Example 2 | $9 \times 10^7$ | $4 \times 10^7$ | $8 \times 10^7$ | $1.2 \times 10^6$ |
| Example 3 | $7 \times 10^7$ | $8 \times 10^6$ | $9 \times 10^6$ | $3 \times 10^6$ |
| Example 4 | $6 \times 10^7$ | $8 \times 10^6$ | $4 \times 10^6$ | $1 \times 10^6$ |
| Comparative Example 1 | $1 \times 10^8$ | $1 \times 10^7$ | $9 \times 10^7$ | $2 \times 10^6$ |
| Comparative Example 2 | $1 \times 10^9$ | $5 \times 10^7$ | $5 \times 10^8$ | $1.5 \times 10^8$ |
| Example 5 | $5 \times 10^8$ | $5 \times 10^7$ | $1 \times 10^7$ | $5 \times 10^6$ |
| Example 6 | $3 \times 10^9$ | $3 \times 10^8$ | $1 \times 10^7$ | $5 \times 10^6$ |
| Example 7 | $2 \times 10^8$ | $1.5 \times 10^7$ | $5 \times 10^6$ | $2 \times 10^6$ |
| Example 8 | $5 \times 10^8$ | $6 \times 10^7$ | $1 \times 10^7$ | $4 \times 10^6$ |
| Comparative Example 3 | $1.5 \times 10^8$ | $1.5 \times 10^7$ | $5 \times 10^6$ | $2 \times 10^6$ |
| Comparative Example 4 | $8 \times 10^7$ | $7 \times 10^6$ | $9 \times 10^6$ | $3 \times 10^6$ |

From the results in Tables 1 and 2 for the "measurement of viscoelasticity", a difference between T1 and T2 for each of the electrophotographic toners (1) to (4) is of the order of 10° C. and a difference therebetween for each of the electrophotographic toners (7) to (10) is 5° C. or smaller. Thus, there is hardly any difference between T1 and T2, and sharp changes in viscoelasticity with respect to temperature, which are derived from the crystallinity of the polyester resin, are shown. On the other hand, a difference between T1 and T2 of each of the electrophotographic toners (5) and (6) is about 50° C. A behavior in which the viscoelasticity lowers slowly as the temperature is increased from the vicinity of a glass transition point, is shown.

For "measurement and evaluation of fine particle agregatting ability (toner blocking resistance)", each of the electrophotographic toners (1) to (4) and (6) to (12) presented a good fine particle stability (fine particle aggregating ability). However, due to the low glass transition point, most of the electrophotographic toner (5) is aggregated. As a result, the electrophotographic toner (5) is not practical at all. Therefore, it is confidently anticipated that the toner blocking resistance of the electrophotographic toner (5) would be poor.

For the "evaluation of low temperature fixability", each of the electrophotographic toners (1) to (4) presented good fixing characteristics in which the image at the bent portion is scarcely peeled with a roll temperature being 130° C. The electrophotographic toner (5) also presented substantially good fixability at 130° C. Further, each of the electrophotographic toners (7) to (10) presented good fixing in which the image at the bent portion is scarcely peeled with a fixing roll temperature within the range of 100 to 130° C. Moreover, each of the electrophotographic toners (11) and (12) showed similar good fixing within a temperature range of 80 to 90° C. However, in the electrophotographic toner (6), the toner viscosity is not fully decreased under the above fixing conditions, and the image is badly peeled off. In order to show good fixing using the electrophotographic toner (6), it is necessary to raise the roll temperature to 160° C.

For the "evaluation of image storability", in each of the electrophotographic toners (1) to (4) and (7) to (10), there is hardly any fusion of images or transfer of the image to the non-image portion of the other image. The electrophotographic toner (11) showed similar good image storability. The level of the electrophotographic toner (6) is better than that of the electrophotographic toner (5). However, because the glass transition point of the electrophotographic toner (6) is as low as 65° C., there is some fusion of images and transfer of the image to the non-image portion of the other image. Because of the lower glass transition point of the electrophotographic toner (5), there is bad fusion of images and transfer of the image to the non-image portion of the other image.

In the evaluation of chargeability, each of the electrophotographic toners (1) to (4) and (7) to (10) showed good charging amounts. However, in each of the electrophotographic toners (5), (6), (11), and (12), due to the high ester group density of the resin, the amount charged is low, and a toner cloud or fog is generated. Therefore, it is obvious that these toners are inappropriate for a developer.

As described above, each of the electrophotographic toners (5), (11) and (12) can have the low temperature fixing to a degree which is substantially the same as for of the electrophotographic toners of the present invention. However, in the electrophotographic toner (5), fine particles are easily aggregated and the image storability is very poor. Accordingly, it is clear that the electrophotographic toner (5) cannot provide all of low temperature fixing, toner blocking resistance, and image storability. Further, the electrophotographic toner (11) has a problem with chargeability, and the electrophotographic toner (12) has problems with image storability and chargeability. Consequently, it is clear that the electrophotographic toners (11) and (12) cannot provide all of low temperature fixing, toner blocking resistance, image storability, and chargeability. Moreover, in the electrophotographic toner (6), the toner blocking resistance is good to a degree substantially the same for the electrophotographic toners of the present invention, however, the low temperature fixability is poor. Thus, similarly, it is clear that the electrophotographic toner (6) cannot provide all of low temperature fixing, toner blocking resistance, and image storability.

As described above, in accordance with the present invention, an electrophotographic toner having excellent low temperature fixability, excellent toner blocking resistance, excellent image storability, and excellent chargeability could be provided. Further, a method of manufacturing the same, an electrophotographic developer, and an image-forming method could be provided.

What is claimed is:

1. An electrophotographic toner comprising a binder resin and a colorant, the binder resin including a crystalline polyester resin which comprises, as a copolycondensation component, a dicarboxylic acid including a sulfonic acid group and/or a diol including a sulfonic acid group as a main component, and an ester density M of the crystalline polyester resin, which is defined in Formula 1 as follows, being from 0.01 to 0.12:

$$M=K/A \qquad \text{Formula 1}$$

wherein M denotes the ester density, K denotes a number of ester groups in a polymer, and A denotes a number of atoms constituting a chain of the polymer, including oxygen atoms which relate to the ester linkage but not including branched chains, hydrogen atoms, and other substituents bonded to the chain of the polymer, and wherein the toner has a temperature interval in which values of a storage modulus $G_L$ and a loss modulus $G_N$ change to one hundredth or smaller of the original values at a temperature range of 10° C. when the temperature of the toner is raised.

2. An electrophotographic toner according to claim 1, wherein the crystalline polyester resin is a straight chain aliphatic polyester resin.

3. An electrophotographic toner according to claim 1, wherein the ester density M is from 0.02 to 0.11.

4. An electrophotographic toner according to claim 1, wherein the ester density M is from 0.04 to 0.10.

5. An electrophotographic toner according to claim 1, wherein the melting point of the crystalline polyester resin falls within the range of from 60 to 120° C.

6. An electrophotographic toner according to claim 1, wherein the crystalline polyester resin is a polyester which comprises an aliphatic dicarboxylic acid as a copolycondensation component.

7. An electrophotographic toner according to claim 1, wherein the crystalline polyester resin is a polyester which comprises an aliphatic diol as a copolycondensation component.

8. An electrophotographic toner according to claim 1, wherein in the conditions of an angular frequency of 1 rad/sec and 30° C., a storage modulus $G_L$ of the toner is at least $1\times10^6$ Pa and a loss modulus $G_N$ of said toner is at least $1\times10^6$ Pa.

9. An electrophotographic developer which comprises a carrier and a toner, wherein the toner is the electrophotographic toner according to claim 1.

10. An electrophotographic developer according to claim 9, wherein the crystalline polyester resin included in the toner is a straight chain aliphatic polyester resin.

11. An electrophotographic developer according to claim 9, wherein in the conditions of an angular frequency of 1 rad/sec and 30° C., a storage modulus $G_L$ of the toner is at least $1\times10^6$ Pa and a loss modulus $G_N$ of said toner is at least $1\times10^6$ Pa.

12. A method of preparing an electrophotographic toner comprising a colorant and a binder resin, the method comprising the steps of:

emulsifying a crystalline polyester resin and colorant;

aggregating and coalescing the emulsified crystalline polyester resin and colorant; and adjusting the crystalline polyester resin and colorant to toner size;

wherein, the binder resin includes the crystalline polyester resin as a main component, and the crystalline polyester resin comprises, as a copolycondensation component, a dicarboxylic acid including a sulfonic acid group and/or a diol including a sulfonic acid group, and an ester density M of the crystalline polyester resin, which is defined in Formula 1 as follows, being from 0.01 to 0.12:

$$M=K/A \qquad \text{Formula 1}$$

wherein M denotes the ester density, K denotes a number of ester groups in a polymer, and A denotes a number of atoms constituting a chain of the polymer, including oxygen atoms which relate to the ester linkage but not including branched chains, hydrogen atoms, and other substituents bonded to the chain of the polymer, and wherein the toner has a temperature interval in which values of a storage modulus $G_L$ and a loss modulus $G_N$ change to one hundredth or smaller of the original values at a temperature range of 10° C. when the temperature of the toner is raised.

13. An image forming method, comprising the steps of:

forming an electrostatic latent image on a surface of a latent image holding material;

providing a developer comprising an electrophotographic toner including a colorant and a binder resin, and the binder resin comprising a crystalline polyester resin as a main component, wherein, the crystalline polyester resin comprises, as a copolycondensation component, a dicarboxylic acid including a sulfonic acid group and/or a diol including a sulfonic acid group, and an ester density M of the crystalline polyester resin, which is defined in Formula 1 as follows, is from 0.01 to 0.12:

$$M=K/A \qquad \text{Formula 1}$$

wherein M denotes the ester density, K denotes a number of ester groups in a polymer, and A denotes a number of atoms constituting a chain of the polymer, including oxygen atoms which relate to the ester linkage but not including branched chains, hydrogen atoms, and other substituents bonded to the chain of the polymer, and wherein the toner has a temperature interval in which values of a storage modulus $G_L$ and a loss modulus $G_N$ change to one hundredth or smaller of the original values at a temperature range of 10° C. when the temperature of the toner is raised;

forming a toner image from the electrostatic latent image formed on the surface of the latent image holding material by using the developer held on a developer holding member;

transferring the toner image formed on the surface of the latent image holding material onto a surface of a transfer material; and heat-fixing the toner image transferred on the surface of the transfer material.

14. A method of preparing an electrophotographic toner comprising a colorant and a binder resin, the method comprising the steps of:

emulsifying a crystalline polyester resin;

adding a colorant and aggregating and coalescing the emulsified crystalline polyester resin and colorant; and adjusting the crystalline polyester resin and colorant to toner size;

wherein, the binder resin includes the crystalline polyester resin as a main component, and wherein, the crystalline polyester resin comprises, as a copolycondensation component, a dicarboxylic acid including a sulfonic acid group and/or a diol including a sulfonic acid group, and an ester density M of the crystalline polyester resin, which is defined in Formula 1 as follows, being from 0.01 to 0.12:

$$M=K/A \qquad \text{Formula 1}$$

wherein M denotes the ester density, K denotes a number of ester groups in a polymer, and A denotes a number of atoms constituting a chain of the polymer, including oxygen atoms which relate to the ester linkage but not including branched chains, hydrogen atoms, and other substituents bonded to the chain of the polymer, and wherein the toner has a temperature interval in which values of a storage modulus $G_L$ and a loss modulus $G_N$ change to one hundredth or smaller of the original values at a temperature range of 10° C. when the temperature of the toner is raised.

* * * * *